US009695534B2

(12) United States Patent
Lee

(10) Patent No.: US 9,695,534 B2
(45) Date of Patent: Jul. 4, 2017

(54) APPARATUS FOR FABRICATING GASKET PADS FOR SEALING DRUM OF DRIER AND GASKET PAD FABRICATED BY THE SAME APPARATUS

(71) Applicant: HEAD LINE CO., LTD., Gwangju (KR)

(72) Inventor: Ho-Jun Lee, Gwangju (KR)

(73) Assignee: HEAD LINE CO., LTD., Gwangju (KR)

( * ) Notice: Subject to any disclaimer, the term of this patent is extended or adjusted under 35 U.S.C. 154(b) by 0 days.

(21) Appl. No.: 14/927,632

(22) Filed: Oct. 30, 2015

(65) Prior Publication Data

US 2017/0067194 A1 Mar. 9, 2017

(30) Foreign Application Priority Data

Sep. 7, 2015 (KR) ..... 10-2015-0126533

(51) Int. Cl.
*D05B 37/04* (2006.01)
*D06F 58/20* (2006.01)

(52) U.S. Cl.
CPC ..... *D05B 37/04* (2013.01); *D06F 58/20* (2013.01)

(58) Field of Classification Search
CPC ..... D05B 37/04; D05B 23/006; D05B 35/06; D05B 35/10
See application file for complete search history.

(56) References Cited

U.S. PATENT DOCUMENTS 3,448,707 A * 6/1969 Gert ..... D05B 23/00 112/130
3,780,679 A * 12/1973 Hanes, Jr. ..... D05B 23/00 112/130
4,503,790 A * 3/1985 Keeton ..... D05B 23/00 112/470.33
4,664,045 A * 5/1987 Landwehr ..... D05B 69/22 112/153
7,293,512 B2 * 11/2007 Tajima ..... D05C 7/08 112/106

FOREIGN PATENT DOCUMENTS

KR 1020100037382 4/2010
KR 101073031 10/2011

* cited by examiner

*Primary Examiner* — Danny Worrell
(74) *Attorney, Agent, or Firm* — Cantor Colburn LLP

(57) ABSTRACT

An apparatus for fabricating gasket pads for sealing a drum of a drier and a gasket pad fabricated. The apparatus automates the operations of guiding a strip of felt textile, cutting a portion of the felt textile by a predetermined length, butting both ends of the cut felt textile portion to each other without a difference in height, and sewing the both ends of the cut felt textile portion. Since gasket pads are fabricated by the automated operations instead of manual operations dependent of the experiences of workers, the same gasket pads can be fabricated with high-quality.

15 Claims, 21 Drawing Sheets

APPARATUS FOR FABRICATING GASKET PADS FOR SEALING DRUM OF DRIER AND GASKET PAD FABRICATED BY THE SAME APPARATUS

BACKGROUND OF THE INVENTION

Field of the Invention

The present invention relates to an apparatus for fabricating gasket pads that closely wrap and seal both ends of a drum of a laundry drier or a variety of driers and a gasket pad fabricated by the same apparatus.

Description of the Related Art

In general, a drier for drying laundry has a drum disposed in the inner space thereof in order to dry washed laundry. Hot wind is blown to the interior of the drum to dry the washed laundry. Here, gasket pads are disposed on both ends of the drum in order to prevent the hot wind supplied to the drum from leaking externally.

The drier is an apparatus automatically drying washed, wet laundry. The drier includes a rotatable drum disposed within a body cabinet, a driving unit rotating the drum, a front support and a rear support defining a drying space by blocking the front part and the rear part of the drum and supporting the front end and the rear end of the drum, and a heater creating hot and dry wind. With this configuration, the drier automatically dries washed, wet clothes or the like.

A gasket pad formed of felt is disposed between the front support and the drum or between the rear support and the drum in order to prevent hot wind from leaking.

Gasket pads are bonded to the front end and the rear end of the drum with an adhesive while wrapping the outer circumferences of the front end and the rear end. When exposed to hot wind for a prolonged period, such a gasket pad may be separated from the drum or may stretch, whereby sealing ability is reduced.

In addition, since both ends of the pad are sewn in a folded position, stepped portions are formed. The stepped portions reduce sealing ability, which is problematic.

In order to overcome this problem, the applicant has been fabricating drum-sealing gasket pads as disclosed in Korean Patent No. 1073031, granted to the applicant. However, the fabrication of gasket pads is performed by manual operations except for the sewing operation, and the operation of cutting gasket pads and the operation of sewing gasket pads are separately performed. These features increase labor costs. In addition, the quality of a product is dependent on the skill of a worker since the fabrication is manually performed.

The information disclosed in the Background of the Invention section is only for the enhancement of understanding of the background of the invention, and should not be taken as an acknowledgment or as any form of suggestion that this information forms a prior art that would already be known to a person skilled in the art.

RELATED ART DOCUMENT

Patent Document 1: Korean Patent No. 1073031 (Oct. 6, 2011, titled "DRUM SEALING GASKET PAD")

Patent Document 2: Korean Patent Application Publication No. 10-2010-0037382 (titled "THERMOPLASTIC ELASTOMER AND GASKET FOR DRUM WASHER FABRICATED THEREFROM")

SUMMARY OF THE INVENTION

Accordingly, the present invention has been made keeping in mind the above problems occurring in the related art, and the present invention is intended to propose an apparatus for fabricating gasket pads for sealing a drum of a drier, the apparatus being able to automate the operations of guiding a strip of felt textile, cutting a portion of the felt textile by a predetermined length, butting both ends of the cut felt textile portion to each other without a difference in height, and sewing the both ends of the cut felt textile portion. Since gasket pads are fabricated by the automated operations instead of manual operations dependent of the experiences of workers, the same gasket pads can be fabricated with high-quality.

Also provided is an apparatus of fabricating gasket pads for sealing a drum of a drier, the apparatus being able to increase the abrasion resistance and thermal resistance of gaskets wrapping and sealing both ends of a drum, prevent static electricity, and impart elasticity to the gaskets, thereby prolonging the operational lifespan and the sealing ability, i.e. airtightness, of the gaskets.

In order to achieve the above object, according to one aspect of the present invention, an apparatus for fabricating gasket pads for sealing a drum of a drier includes a textile feed guide part, a textile length-adjusting part, a cutting part, a textile gripping part, a carriage, a sewing part, a discharging part, and a control part. The textile feed guide part is disposed on one side of an upper surface of a support table. The textile feed guide part includes: an anti-twisting drum rotating in a direction opposite to a direction in which a strip of felt textile is fed such that the felt textile manufactured to maintain a predetermined width is fed without being twisted; and a feed roller and a guide roller facing each other such that the felt textile that has passed through the anti-twisting drum enters through a space between the feed roller and the guide roller in one side and exits through the other side. The textile length-adjusting part is disposed downstream of the textile feed guide part. The textile length-adjusting part includes: a body; a withdrawal roller disposed on one side of the body to be in close contact with one surface of the felt textile fed by the feed roller, wherein the withdrawal roller is rotation-controlled by a motor such that a predetermined length of the felt textile that has entered through one side is withdrawn through the other side; a support roller facing the withdrawal roller to rotate when the withdrawal roller rotates; a textile gripper disposed downstream of the withdrawal roller to grip one end portion of the felt textile withdrawn by the withdrawal roller; and a textile gripper moving part reversing the textile gripper to obtain a withdrawal space for the felt textile. The cutting part is disposed under the withdrawal roller to cut a felt textile portion of the felt textile withdrawn by the predetermined length. The textile gripping part includes: two grippers spaced apart from each other, the grippers holding and gripping one end portion of the felt textile portion gripped by the textile gripper and the other end portion of the felt textile portion that has passed through the withdrawal roller and is cut by the cutting part; and a rotating part rotating the grippers to butt one end portion of the felt textile portion and the other end portion of the felt textile portion to each other. The grippers are disposed on both sides of an upper portion of the carriage. The carriage includes: a felt textile support part disposed on a central portion and having a support plate supporting one end portion and the other end portion of the felt textile portion butted to each other; air supply pipes disposed to blow air onto upper surfaces of one end portion and the other end portion of the felt textile portion butted to each other and placed on the support; and a movement controlling part allowing the carriage to move to a sewing part. The sewing part is disposed on the other side of the upper surface of the support table, wherein the sewing part presses the felt textile portion moved by the carriage and placed on a sewing surface using pressing pieces and sews the felt textile portion pressed by the pressing pieces. The discharging part is disposed on the sewing part to push a side of a gasket pad that has been completely sewn such that the gasket pad drops to a loading hopper. The loading hopper is disposed below the support table to accommodate the gasket pad dropped by the discharging part. The control part is disposed at a selected position on the upper surface of the support table.

According to the apparatus of fabricating gasket pads for sealing a drum of a drier having the above-described configuration, gasket pads are fabricated through a series of automated operations of feeding, moving, and cutting a strip of felt textile, butting both ends of a cut felt textile portion to each other, and sewing the butted both ends of the cut felt textile. It is therefore possible to reduce the amount of time for the fabrication of gasket pads and reduce labor costs, thereby reducing prices. The automated fabrication process can fabricate the same gasket pads having high quality and increase the yield of products.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Figure 1:
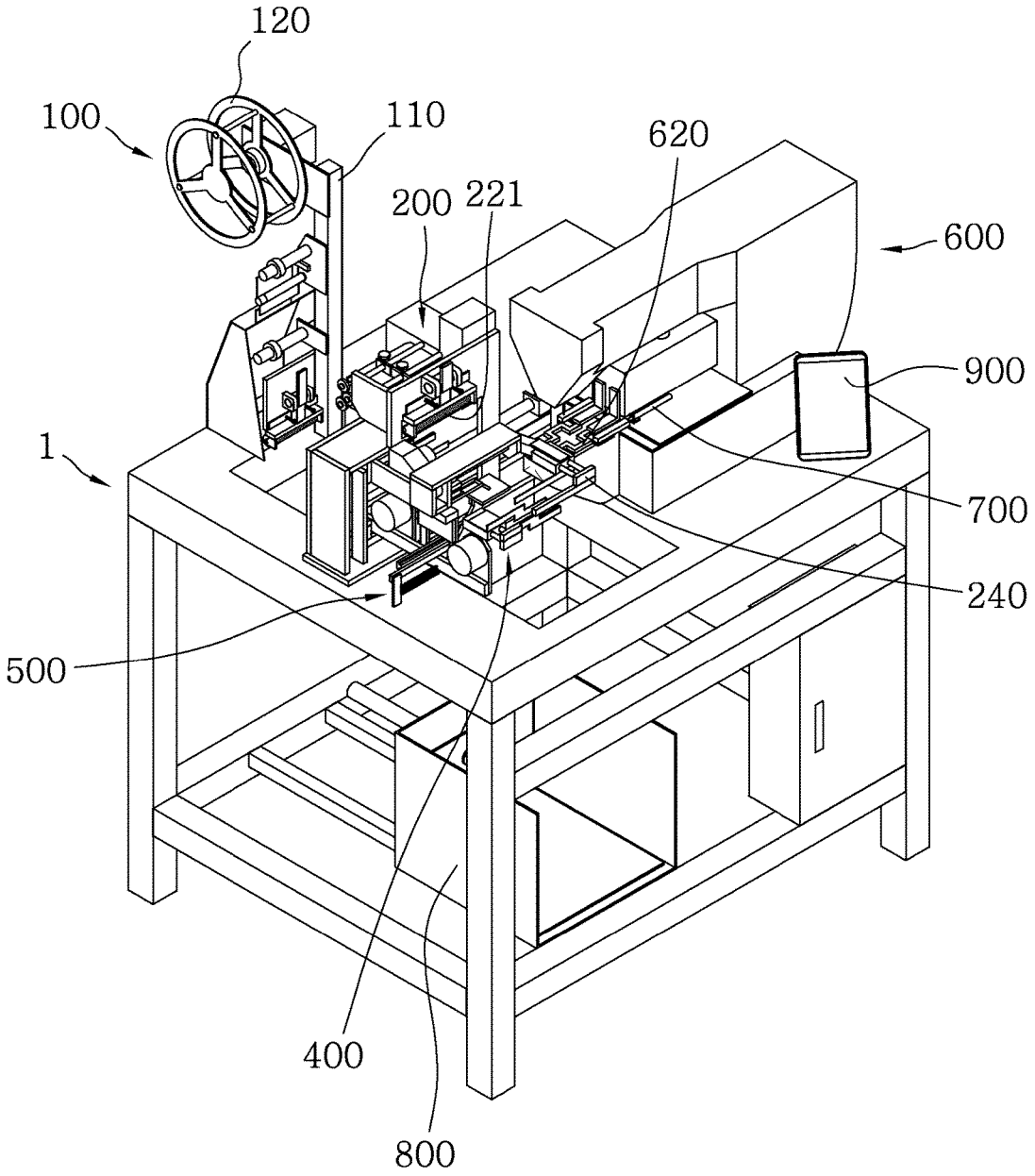
FIG. 1 is a perspective view illustrating an apparatus of fabricating gasket pads for sealing a drum of a drier according to an embodiment of the present invention.

Reference will now be made in greater detail to apparatus of fabricating gasket pads for sealing a drum of a drier and a gasket pad fabricated thereby according to exemplary embodiments of the present invention, examples of which are illustrated in the accompanying drawings. Wherever possible, the same reference numerals will be used throughout the drawings and the description to refer to the same or like parts.

As illustrated in FIG. 1, the apparatus of fabricating gasket pads for sealing a drum of a drier according to an embodiment of the present invention includes a textile feed guide part 100, a textile length-adjusting part 200, a cutting part 300, a textile gripping part 400, a carriage 500, a sewing part 600, a discharging part 700, a loading hopper 800, and a controlling part 900.

The textile feed guide part 100 is disposed on an upper surface portion of a support table 1, and is configured to feed a strip of felt textile to the textile length-adjusting part 200. The strip of felt textile is manufactured by primary machining such that both edges have a double layer structure and a predetermined width is maintained. The textile feed guide part 100 includes a feed roller 140 feeding the strip of felt textile.

The textile length-adjusting part 200 is configured to withdraw the strip of felt textile fed through the textile feed guide part 100 by a preset length. The textile length-adjusting part 200 includes a withdrawal roller 220 controlling the withdrawal of the felt textile and a textile gripper 240 holding and gripping one end of the felt textile withdrawn through the withdrawal roller 220.

That is, in the state in which one end of the felt textile is held and gripped by the textile gripper 240, the withdrawal roller 220 withdraws the felt textile by a predetermined length. One end portion and the other end portion of the portion of the felt textile withdrawn in this manner are gripped by grippers 410. After being gripped, the other end portion of the felt textile is cut by the cutting part 300.

The cutting part 300 is disposed below the feed roller 140 such that the other end portion of the withdrawn felt textile portion is cut in the direction accurately perpendicular to the longitudinal direction of the felt textile.

In the textile gripping part 400, the two grippers 410 are spaced apart from each other in order to hold and grip one end portion of the felt textile gripped by the textile gripper 240 and the other end portion of the felt textile that has passed through the withdrawal roller 220. A rotating part 420 rotates the grippers 410 by which one end of the felt textile and the other end of the felt textile portion cut by the cutting part 300 are butted to each other.

That is, the grippers 410 are rotated by controlling the rotating part 420 such that both ends of the felt textile gripped by the grippers 410 are butted to each other. The grippers 410 are configured to be rotated 180° by the rotating part 420.

The rotating part 420 may be embodied as a motor connected to one end of the grippers 410 by means of a gear or a belt to transfer power.

The carriage 500 has the grippers 410 on both sides of the upper portion thereof. A felt textile support part 530 having a support plate 531 is disposed in the central portion of the carriage 500 to support both end portions of the felt textile butted to each other. Air supply pipes 550 are disposed to supply air to the upper surface of the both end portions of the felt textile butted to each other above the support plate 531. The air supply pipes 550 are moved toward the sewing part 600 by a movement controlling part 560.

In addition, the sewing part 600 is disposed on the other side of the upper surface of the support table 1, and has pressing pieces 620 pressing the felt textile that is moved and placed on a sewing surface 610 by the carriage 500. The ends of the felt textile butted to each other are sewn together using a sewing needle is disposed in a sewing space between the pressing pieces 620.

The discharging part 700 is disposed on the sewing part 600, and is configured to push a side surface of a gasket pad that has been completely sewn such that the gasket pad drops to the loading hopper 800. The loading hopper 800 is disposed below the support table 1, and is configured to load the gasket pad dropped thereinto.

In addition, the control part 900 is a component controlling the other components of the fabricating apparatus according to the present embodiment. The control part 900 has a control box that is separately disposed, and has a touch-type display screen at a selected position on the upper surface of the support table 1 such that signals for controlling the components are input on the display screen.

Thus, a worker fabricates gasket pads by inputting information by touching the screen.

As described above, the fabricating apparatus according to the present embodiment fabricates an annular gasket pad by feeding a strip of felt textile using the textile feed guide part 100, withdrawing a predetermined length of the felt textile using the textile length-adjusting part 200, holding the felt textile using the textile gripping part 400, cutting the predetermined length of the felt textile using the cutting part 300, bring both ends of the cut portion of the felt textile to be butted to each other, and subsequently sewing the both ends together using the sewing part 600. Afterwards, the discharging part 700 discharges the gasket pad from the sewing part 600 such that the gasket pad is loaded in the loading hopper 800. Through this process, the felt textile is automatically fed, and annular gasket pads are fabricated.

Hereinafter, the components of the apparatus for fabricating a gasket pad according to the present invention will be described in detail.

Figure 2:
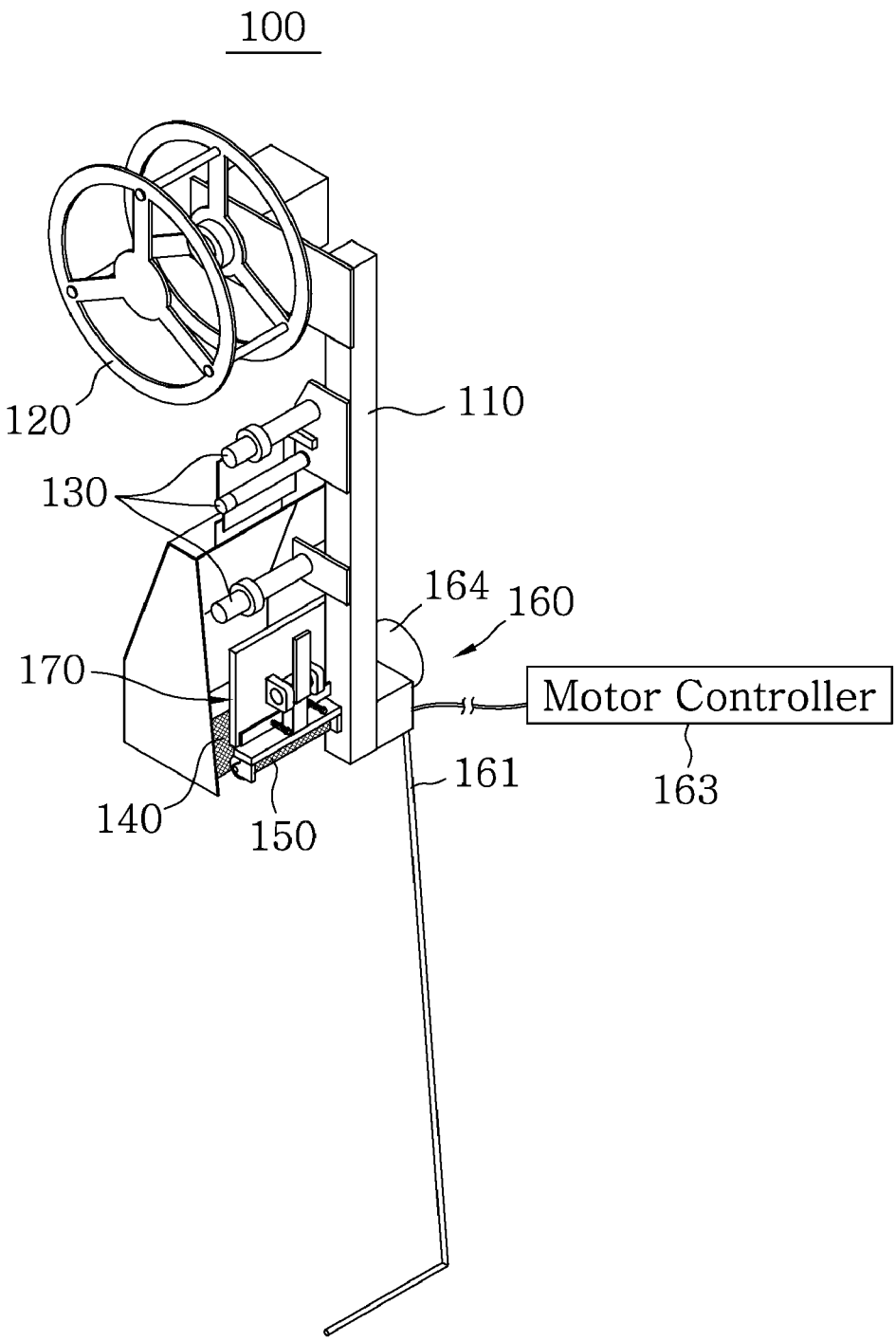
FIG. 2 is a fragmentary view illustrating the textile feed guide part of the apparatus of fabricating gasket pads for sealing a drum of a drier according to the embodiment of the present invention.

As illustrated in FIG. 2, the textile feed guide part 100 includes a support 110, an anti-twisting drum 120, a plurality of guide rods 130, the feed roller 140, a guide roller 150, and a feed roller controlling part 160.

The anti-twisting drum 120 is disposed on the upper portion of the support 110. The anti-twisting drum 120 is configured to be rotated using a motor (not shown) in the opposite direction to the direction in which the felt textile is fed such that the felt textile can be fed without twisting.

The guide rods 130 are disposed on the middle portion of the support 110 at predetermined distances from each other to guide the movement of the felt textile that has passed through the anti-twisting drum 120. The guide rods 130 may be implemented as round rods or boards having a predetermined surface area.

The feed roller 140 is configured to be rotated by a feed roller driving motor 164, and is disposed on the lower portion of the support 110 such that the feed roller 140 is in close contact with one surface of the felt textile. Thus, the feed roller 140 feeds the felt textile to the textile length-adjusting part 200 by pulling the felt textile while being rotated by the driving force of the feed roller driving motor 164. Here, the feed roller 140 is close to the guide roller 150 such that the felt textile is withdrawn through the space between the feed roller 140 and the guide roller 150.

The guide roller 150 is disposed at a position facing the feed roller 140. The guide roller 150 is configured to support the feed roller 140 while supporting the other surface of the felt textile through close contact. In this state, when the feed roller 140 rotates, the guide roller 150 is rotated by the rotating force of the feed roller 140 to guide the felt textile to be withdrawn.

The feed roller controlling part 160 is configured to restrain the feed of the felt textile by controlling the driving of the feed roller 140. According to an embodiment, the feed roller controlling part 160 includes a measuring bar 161, a rotation angle detector 162, a motor controller 163, and the feed roller driving motor 164.

One end of the measuring bar 161 is placed on the upper surface of the felt textile entering the textile length-adjusting part 200. The rotation angle detector 162 is disposed on the other end of the measuring bar 161, and is configured to detect the angle of rotation of the measuring bar 161 and sending a detection signal to the motor controller 163. The motor controller 163 is configured to control the feed roller driving motor 164 in response to the detection signal received from the rotation angle detector 162.

The feed roller driving motor 164 is directly or indirectly connected to the feed roller 140. The feed roller driving motor 164 is operated under the control of the motor controller 163 to rotate the feed roller, which in turn feeds the felt textile to the textile length-adjusting part 200 by pulling the felt textile.

Figure 3:
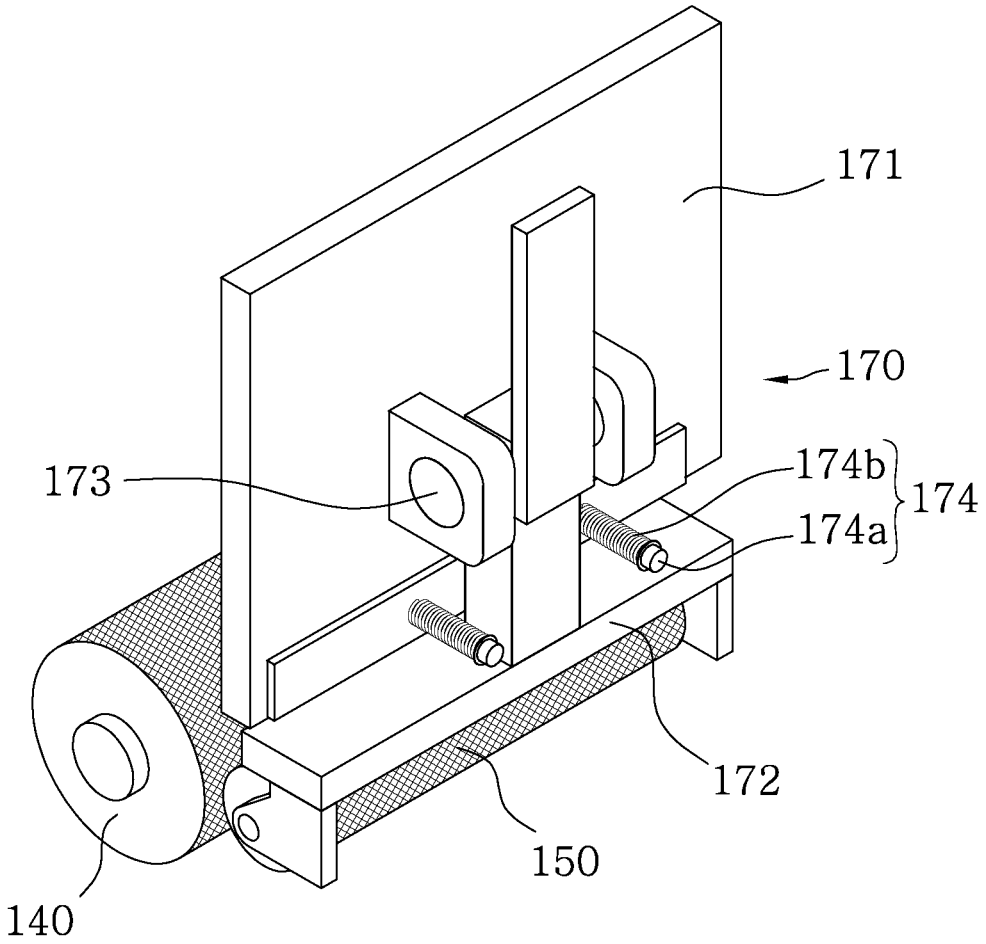
FIG. 3 is a perspective view illustrating the first pressing part according to the embodiment of the present invention.

As illustrated in FIG. 3, it is preferable that the guide roller 150 is provided to be in close contact with one surface of the felt textile due to elastic force applied from a first pressing part 170. This is because the feed roller 140 is required to be as close as possible to the other surface of the felt textile such that the feed of the felt textile can be controlled using the feed roller 140.

According to an embodiment, the first pressing part 170 includes a pressing member support plate 171, a roller fixing member 172, and an elasticity-applying part 174. The pressing member support plate 171 is disposed perpendicular to the support 110. The central portion of the roller fixing member 172 is coupled to the outer surface of the pressing member support plate 171 by means of a hinge shaft 173. The guide roller 150 is horizontally disposed below the roller fixing member 172. The elasticity-applying part 174 is disposed on the lower portion of the pressing member support plate 171 to apply elastic force to the guide roller 150, and includes a bolt 174 and a spring **174*b***.

That is, as the roller fixing member 172 is elastically moved in the direction of the feed roller 140 by the elasticity-applying part 174, the guide roller 150 is accurately brought into close contact with the other surface of the felt textile supported on the feed roller 140.

Figure 4:
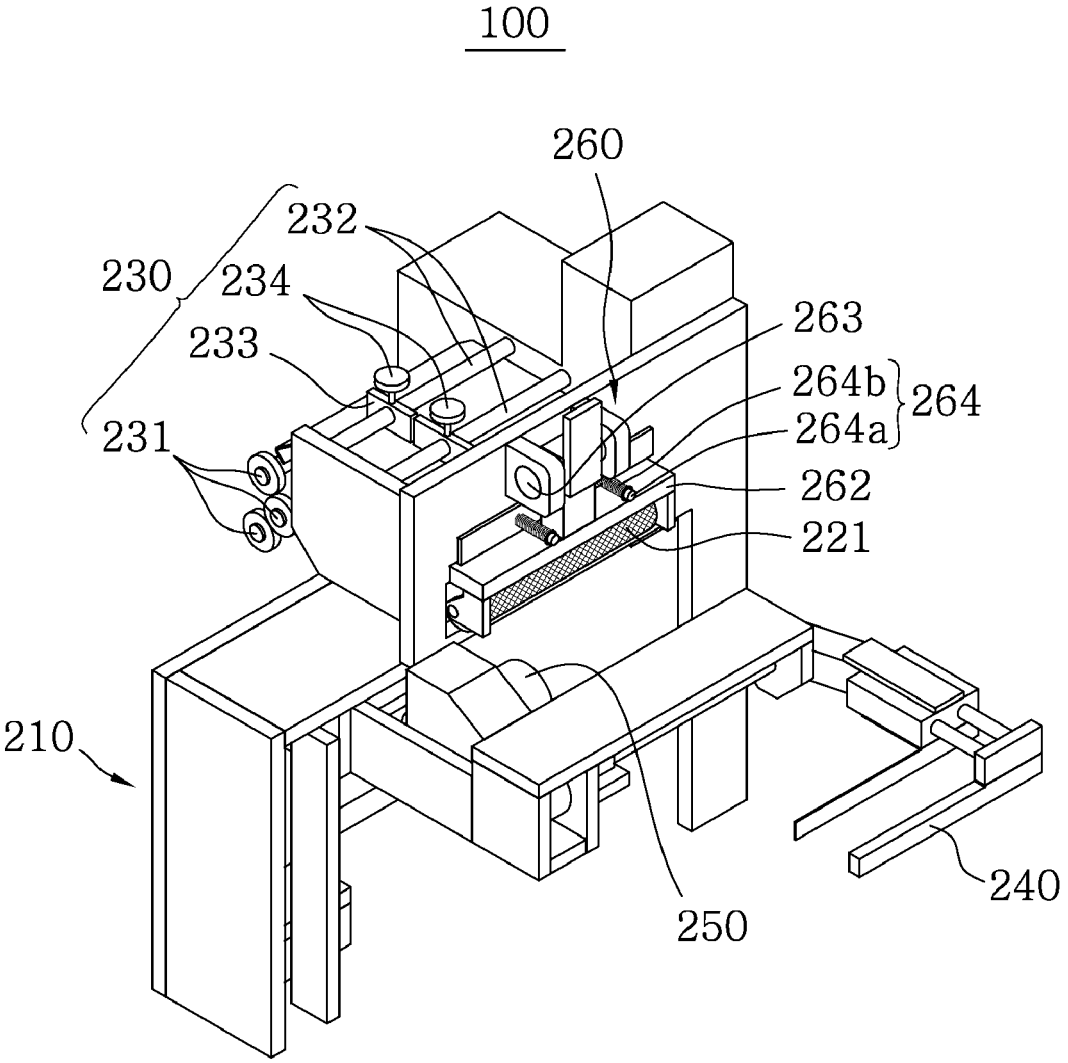
FIG. 4 is a fragmentary view illustrating the textile length-adjusting part of the apparatus of fabricating gasket pads for sealing a drum of a drier according to the embodiment of the present invention.

As illustrated in FIG. 4, the textile length-adjusting part 200 includes a body 210, the withdrawal roller 220, a support roller 221, a textile guide part 230, the textile gripper 240, and a textile gripper moving part 250.

The body 210 is disposed on the upper surface of the support table 1. The withdrawal roller 220 is disposed on a distal portion of the body 210 such that the withdrawal roller 220 is rotated by power from a motor. The withdrawal roller 220 is disposed in close contact with one surface of the felt textile fed by the feed roller 140. The felt textile enters through one side of the withdrawal roller 220, and a predetermined length of the felt textile is withdrawn through the other side of the withdrawal roller 220.

The textile guide part 230 is disposed upstream of the withdrawal roller 220 to guide the felt textile fed by the feed roller 140. The textile guide part 230 is configured to guide the felt textile to enter in the direction perpendicular to the longitudinal direction of the withdrawal roller 220.

Specifically, the textile guide part 230 is a component allowing the felt textile to be cut in the direction accurately perpendicular to the longitudinal direction of the felt textile when the felt textile is cut by the cutting part 300 positioned below the withdrawal roller 220. The felt textile is cut in the accurately perpendicular direction such that both ends of the cut portion of the felt textile to be accurately butted to each other without a gap. This can consequently reduce defects in the sewing operation performed by the sewing part 600 and lead to the fabrication of high-quality gasket pads.

The specific structure of the textile guide part 230 includes backing members 231 disposed on one side of the body 210 to support the felt textile, upper support rods 232 disposed above and apart from the backing members 231 to prevent the felt textile moving while being supported on the backing members 231 from becoming loose, and close contact plates 233 disposed on the upper support rods 232 such that the positions thereof are adjustable. Each of the close contact plates 233 is fixed by a corresponding fixing member 234, and supports one surface of the felt textile through close contact therewith, whereby the other surface of the felt textile is brought into close contact with one surface of the body 210.

Thus, the felt textile can accurately enter the withdrawal roller in a position in which the felt textile is transported on the close contact plates 233 without twisting and is prevented from becoming loose by the upper support rods 232.

The backing members 232 may be implemented as a plurality of rolls or rods.

The textile gripper 240 is disposed downstream of the withdrawal roller 220, and is configured to hold one end portion of the felt textile withdrawn by the withdrawal roller 220, whereby a predetermined length of the felt textile can be withdrawn by the withdrawal roller 220.

The textile gripper 240 holds one end portion of the felt textile, and subsequently, is moved backwards by the textile gripper moving part 250 such that a space through which the felt textile is to be withdrawn is defined.

The textile gripper moving part 250 may be implemented as any device able to move the textile gripper backwards, such as a motor or a cylinder. According to the present embodiment, the textile gripper moving part 250 includes a motor and a rotary rod having one end coupled to the driving shaft of the motor. The rotary rod is rotated through the actuation of the motor in order to move the textile gripper toward or away from the withdrawal roller.

In the meantime, the support roller 221 is disposed to be in close contact with the other surface of the felt textile due to elastic force applied thereto from a second pressing part 260, such that the withdrawal of the felt textile by the withdrawal roller 220 can be accurately controlled.

The second pressing part 260 includes a roller fixing member 262 and an elasticity applying part 264. The central portion of the roller fixing member 262 is coupled to the outer surface of one side of the body 210 by means of a hinge shaft 263, and the support roller 221 is horizontally disposed below the roller fixing member 262. The elasticity applying part 264 is disposed on the lower portion of the roller fixing member 262 to apply elastic force to the support roller 221. The elasticity applying part 264 includes a bolt 264*a* and a spring 264*b*.

Thus, the elasticity applying part 264 drives the roller fixing member 262 to move toward the direction of the body 210, whereby the support roller 221 is accurately brought into close contact with the other surface of the felt textile. Since the ability of close contact is improved, the felt textile can be more accurately withdrawn by the withdrawal roller 220.

Figure 5:
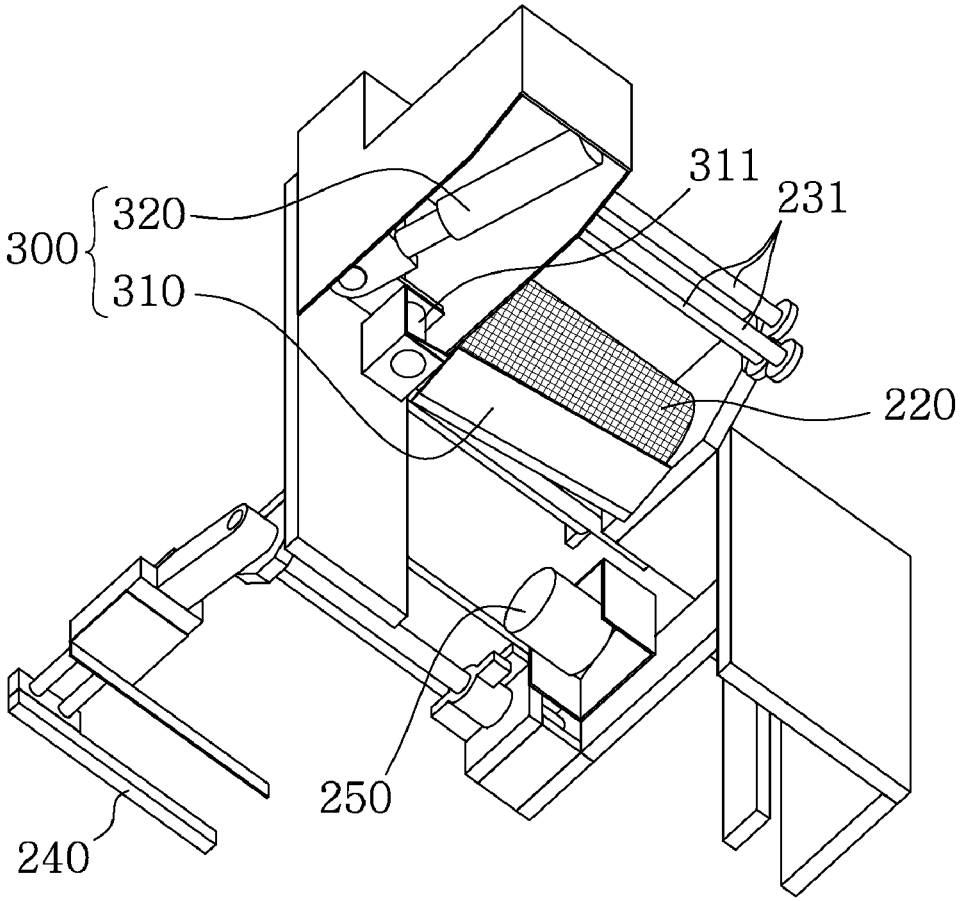
FIG. 5 is a view illustrating an exemplary cutting part of the present invention.

As illustrated in FIG. 5, the cutting part 300 includes a cutting blade 310 and a blade rotating part 320. One portion of the cutting blade 310 is pivotably coupled to the body of the textile length-adjusting part 200 by means of a pivot shaft 311. The blade rotating part 320 is disposed on one end of the pivot shaft 311 such that the cutting blade 310 is rotated by rotating force applied thereto from the pivot shaft 311.

Thus, the cutting blade 310 cuts the felt textile while being rotated by the blade rotating part 320.

The blade rotating part 320 may be implemented as a cylinder or a motor. According to the present embodiment, the blade rotating part 320 is implemented as a cylinder to rotate the cutting blade 310.

Figure 6:
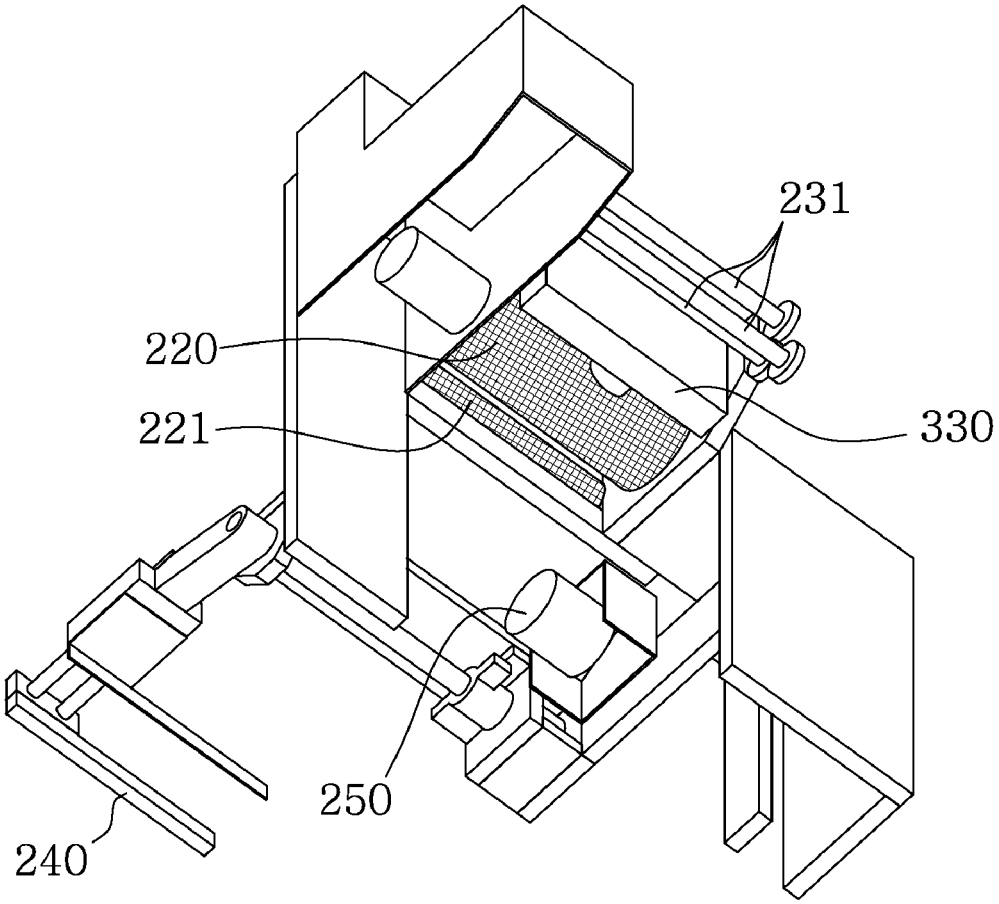
FIG. 6 is a view illustrating another exemplary cutting part of the present invention.

As illustrated in FIG. 6, another embodiment of the cutting part 300 may be implemented as a laser generator 330 disposed on the body 210 of the textile length-adjusting part 200 to cut the felt textile by emitting a laser beam.

When the laser generator 330 is implemented as the cutting part 300, it is possible to advantageously remove the possibility that a thread sewn in the primary machining and present in the felt textile may be untied, compared to the case in which the cutting blade 310 is used.

The cutting part 300 cuts the felt textile by a length equivalent to the outer diameter of a portion of a drum to be sealed.

Figure 7:
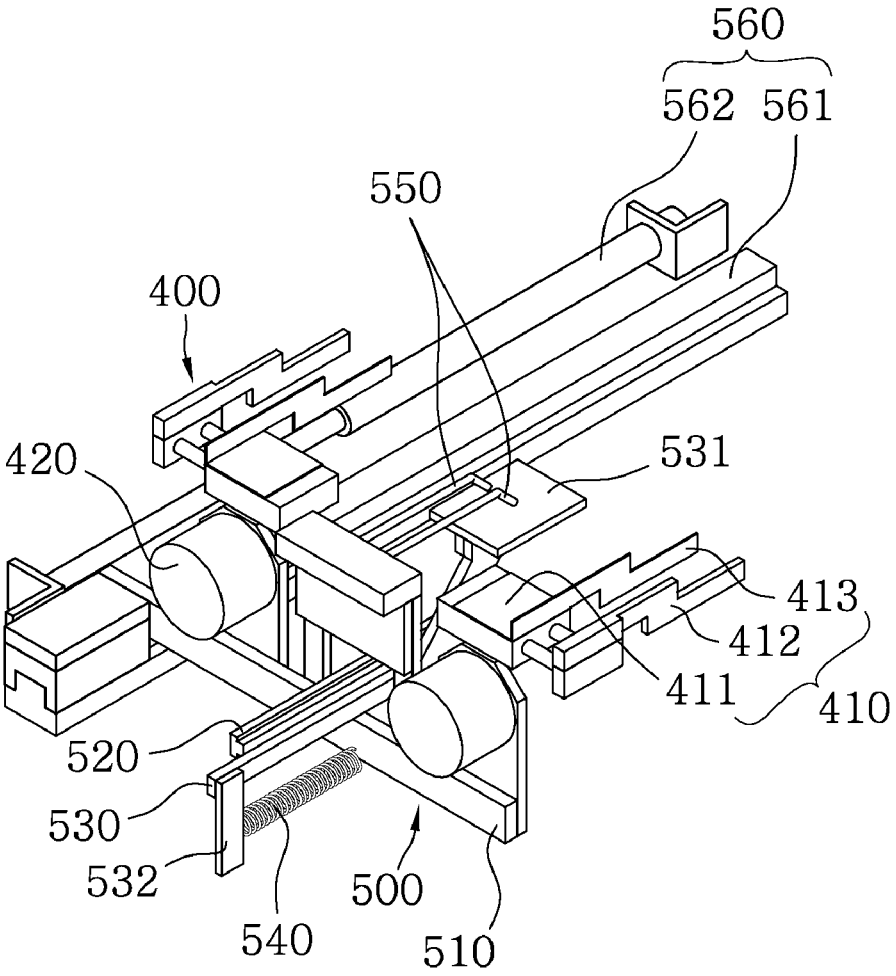
FIG. 7 is a fragmentary view illustrating the textile gripping part and the carriage of the apparatus of fabricating gasket pads for sealing a drum of a drier according to the embodiment of the present invention.

As illustrated in FIG. 7, the textile gripping part 400 is configured to bring both ends of the portion of the felt textile cut by a predetermined length to be butted to each other by holding the both ends of the cut portion with the grippers 410. The textile gripping part 400 includes the grippers 410 and the rotating part 420 rotating the grippers 410.

According to an embodiment, each of the grippers 410 includes a cylinder 411, a first holding plate 412 disposed on a rod end of the cylinder 411, and a second holding plate 413 disposed on one end of the cylinder 411 to face the first holding plate 412. The second holding plate 413 comes into close contact with the first holding plate 412 in response to an entering operation of the rod.

Thus, it is possible to hold and grip the felt textile by bringing the second holding plate 413 into close contact with the first holding plate 412 in response to the operation of the rod of the cylinder 411.

In addition, an embodiment of the rotating part 420 may be implemented as an air motor coupled to the cylinder 411 to rotate the cylinder 411.

According to the present embodiment, the grippers 410 are positioned on the same horizon, and are operated to rotate 90°, thereby bringing both ends of the felt textile held therein together to be butted to each other.

As illustrated in FIG. 7, the carriage 500 includes a carriage body 510, a guide rail 520, the felt textile support part 530, an elastic spring 540, and the air supply pipes 550. Here, the grippers 410 are disposed on both sides of the carriage body 510.

The guide rail 520 is disposed on the central portion of the carriage body 510, in the direction of the sewing part 600. A lower portion of the felt textile support part 530 is bound to the guide rail 520 such that felt textile support part 530 can slide.

A support 531 is disposed on the upper surface of one side of the felt textile support part 530 to support both ends of the felt textile butted to each other by the grippers 410, and a stopper 532 is disposed on the other side of the felt textile support part 530 to prevent the felt textile support part 530 from being dislodged from the guide rail 520.

The elastic spring 540 is disposed between the carriage body 510 and the other side of the felt textile support part 530 or the stopper 532. The elastic spring 540 is configured to apply elastic force to the felt textile support part 530 when the support 531 collides with the side surface of the sewing part 600.

Thus, as the felt textile support part 530 is moved to the rear portion of the carriage body 510 along with the guide rail 520, both ends of the felt textile placed on the support 531 are moved toward the sewing surface 610 of the sewing part 600 in a position in which the both ends are gripped by the grippers 410.

When the carriage body 510 moved to the sewing part 600 returns to the original position, the felt textile support part 530 returns to the original position due to the elastic force of the elastic spring 540.

The air supply pipes 550 are disposed above the carriage body 510, and serve to blow air onto the upper surfaces of both ends of the felt textile placed on the support 531.

This can consequently prevent the both ends of the felt textile from becoming loose, thereby improving sewing quality in the sewing part 600.

In the meantime, the movement controlling part 560 according to the present embodiment includes a carriage guide rail 561 and a cylinder 562. One side of the carriage body 510 is bound to the carriage guide rail 561. The carriage guide rail 561 is disposed in the direction of the sewing part 600, and guides the carriage body 510 to move toward the sewing part 600. The cylinder 562 causes the carriage body 510 to move on the carriage guide rail 561.

Thus, in response to the operating of the cylinder 562 driving the rod to retract and protrude, the carriage body 510 is moved on the carriage guide rail 561.

Figure 8:
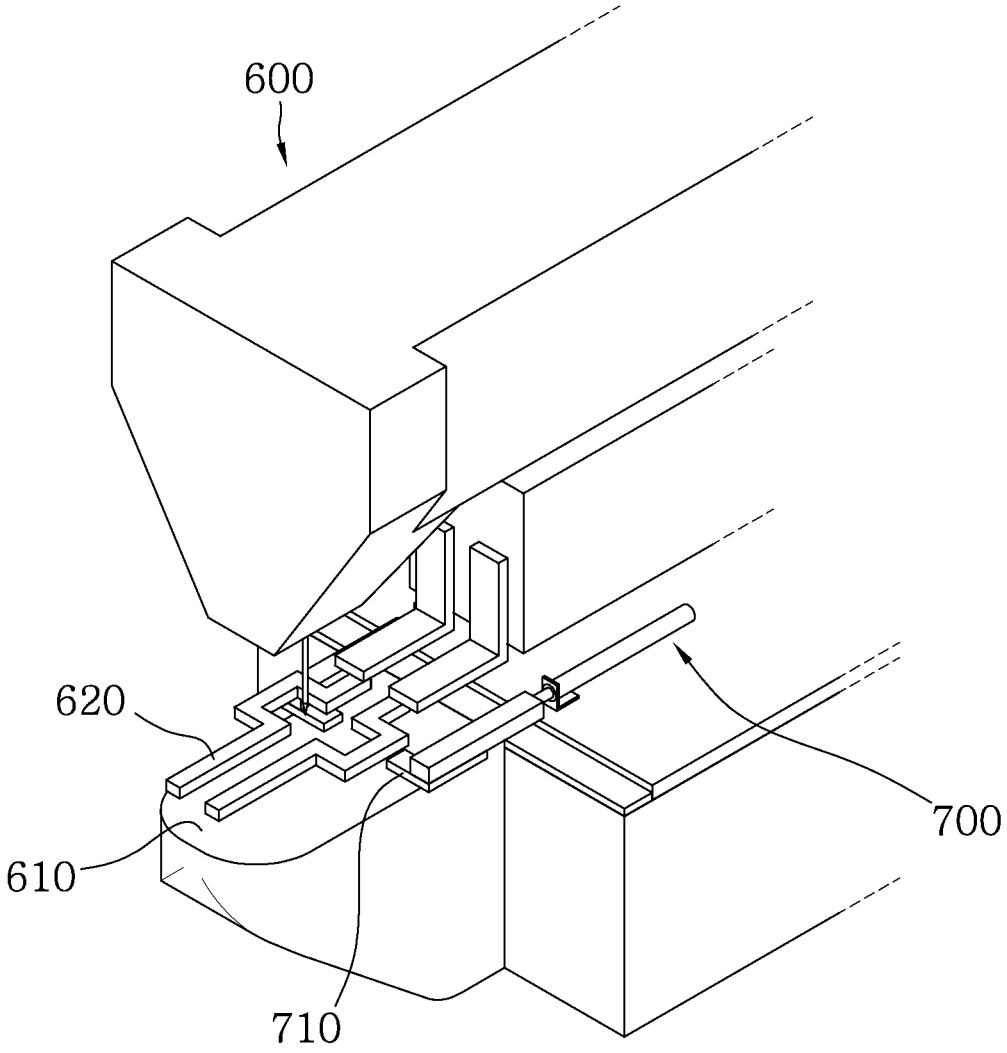
FIG. 8 is a fragmentary view illustrating the sewing part of the apparatus of fabricating gasket pads for sealing a drum of a drier according to the embodiment of the present invention.

As illustrated in FIG. 8, the sewing part 600 is configured to sew both ends of the felt textile butted to each other. The sewing part 600 may be implemented as a typical sewing machine.

Here, the pressing pieces 620 are disposed to press the both ends of the felt textile for the sewing operation.

The structure of the pressing pieces 620 according to the present embodiment differs from the structure of known pressing pieces.

Figure 9:
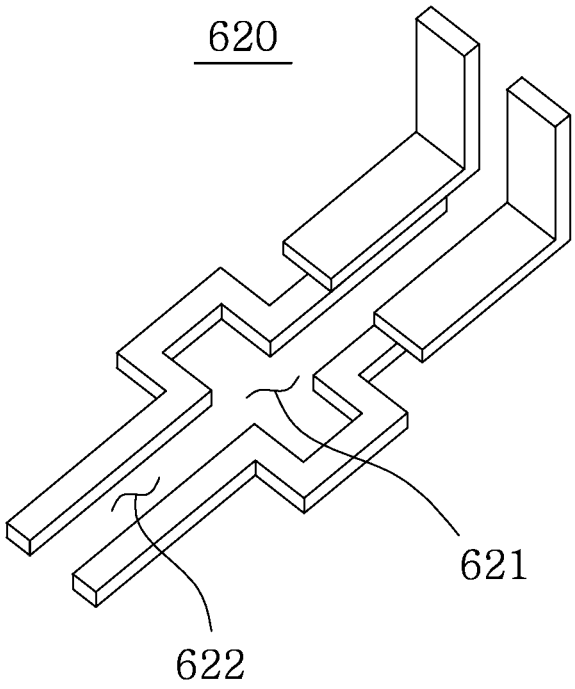
FIG. 9 is a perspective view illustrating the pressing pieces according to the embodiment of the present invention.

As illustrated in FIG. 9, the sewing space between the pressing pieces 620 is defined such that the width of a first sewing space 621 positioned at one side is greater than the width of a second sewing space 622 positioned at the other side. With this configuration, after the felt textile is primarily fixed by sewing a long, first sewing line in the first sewing space 621, secondary sewing is performed along a second sewing line shorter than the first sewing line while reciprocally moving between the second sewing space 622 and the first sewing space 621. This can consequently minimize that the ends of the felt textile are spaced apart from each other or the felt textile is twisted during the sewing operation.

The discharging part 700 is configured to push a gasket pad after the completion of the sewing operation to drop into the loading hopper 800. The discharging part 700 may be implemented as a cylinder.

A metal piece 710 may be formed on the rod end of the cylinder, in the direction perpendicular to the direction of the cylinder, such that the metal piece 710 can easily push the gasket through contact with side portions of the gasket pad.

The loading hopper 800 is disposed below the support table 1. For this, the support table 1 has a predetermined height.

Figure 10:
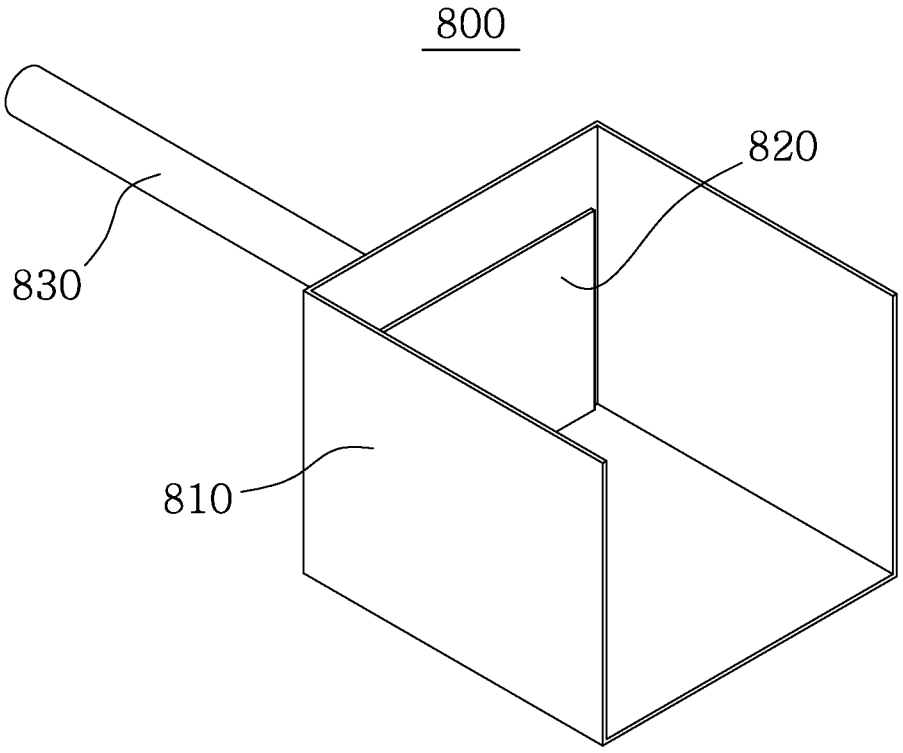
FIG. 10 is a fragmentary view illustrating the loading hopper of the apparatus of fabricating gasket pads for sealing a drum of a drier according to the embodiment of the present invention.

As illustrated in FIG. 10, the loading hopper 800 includes a loading bucket 810, a withdrawal plate 820, and a withdrawal cylinder 830. The loading bucket 810 is open in the upper side and a lateral side. The withdrawal plate 820 is disposed to be reciprocally movable within the loading bucket 810, and serves to withdraw gasket pads loaded therein through the open lateral side. The withdrawal cylinder 830 reciprocally moves the withdrawal plate 820.

When a predetermined number of fabricated gasket pads are loaded in the loading bucket 810, the withdrawal cylinder 830 is operated to push the withdrawal plate 820, thereby discharging the loaded gasket pads externally.

Figure 11:
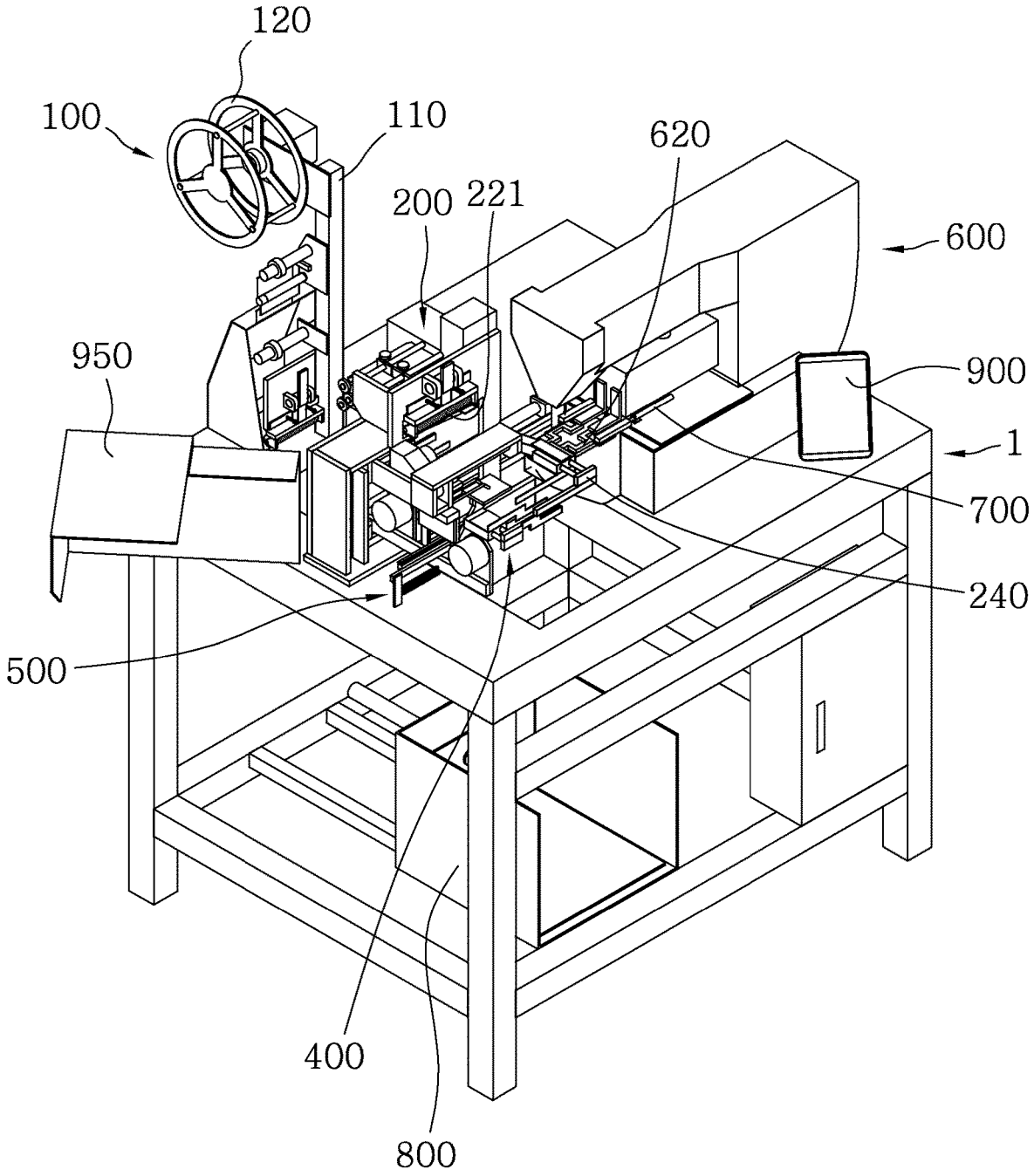
FIG. 11 is a perspective view illustrating the apparatus of fabricating gasket pads for sealing a drum of a drier having a protective cover according to the embodiment of the present invention.
Figure 12:
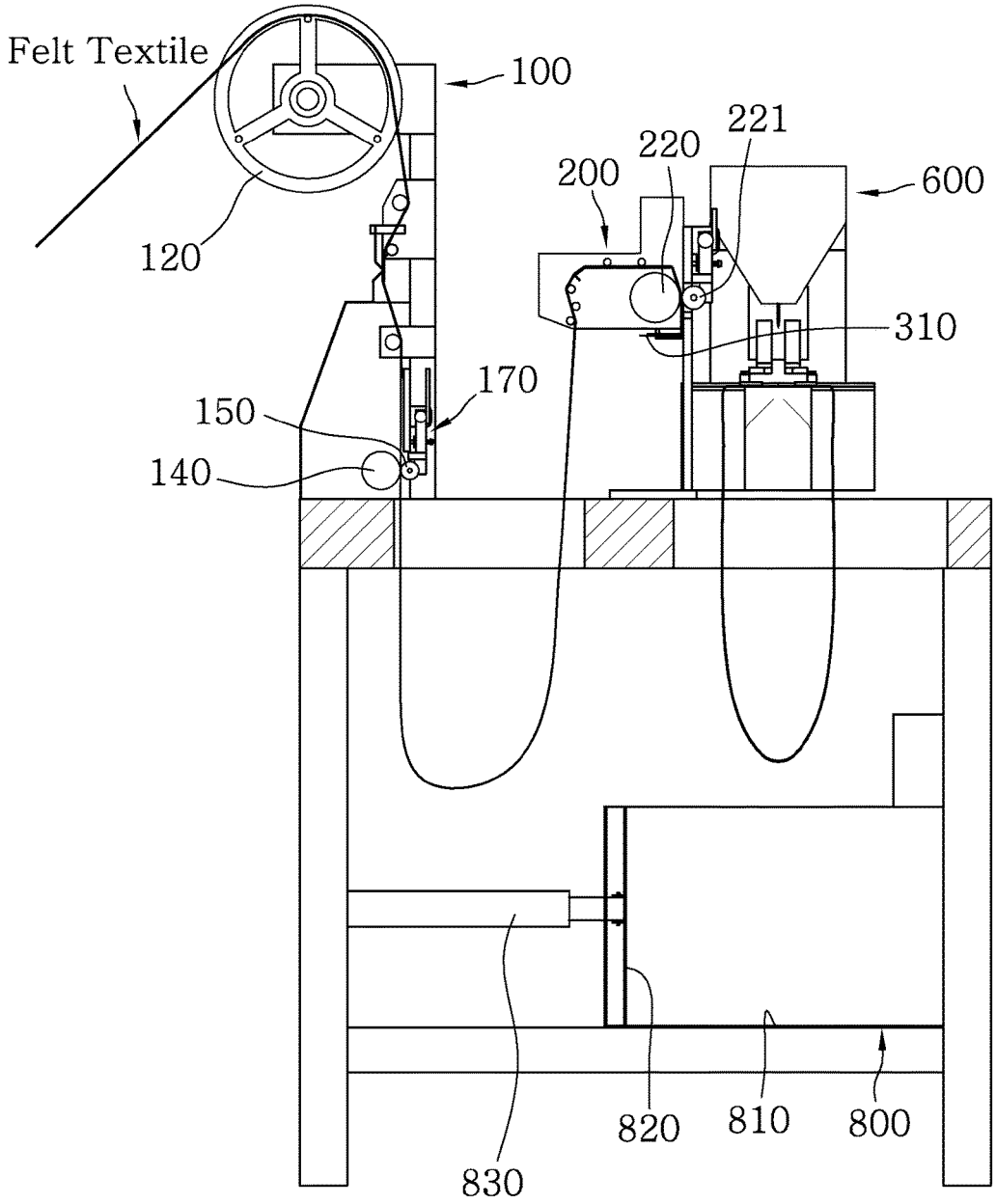
FIGS. 12 to 17 are views illustrating a side part of the apparatus of fabricating gasket pads for sealing a drum of a drier in the process of moving and sewing a felt textile according to the present invention.
Figure 13:
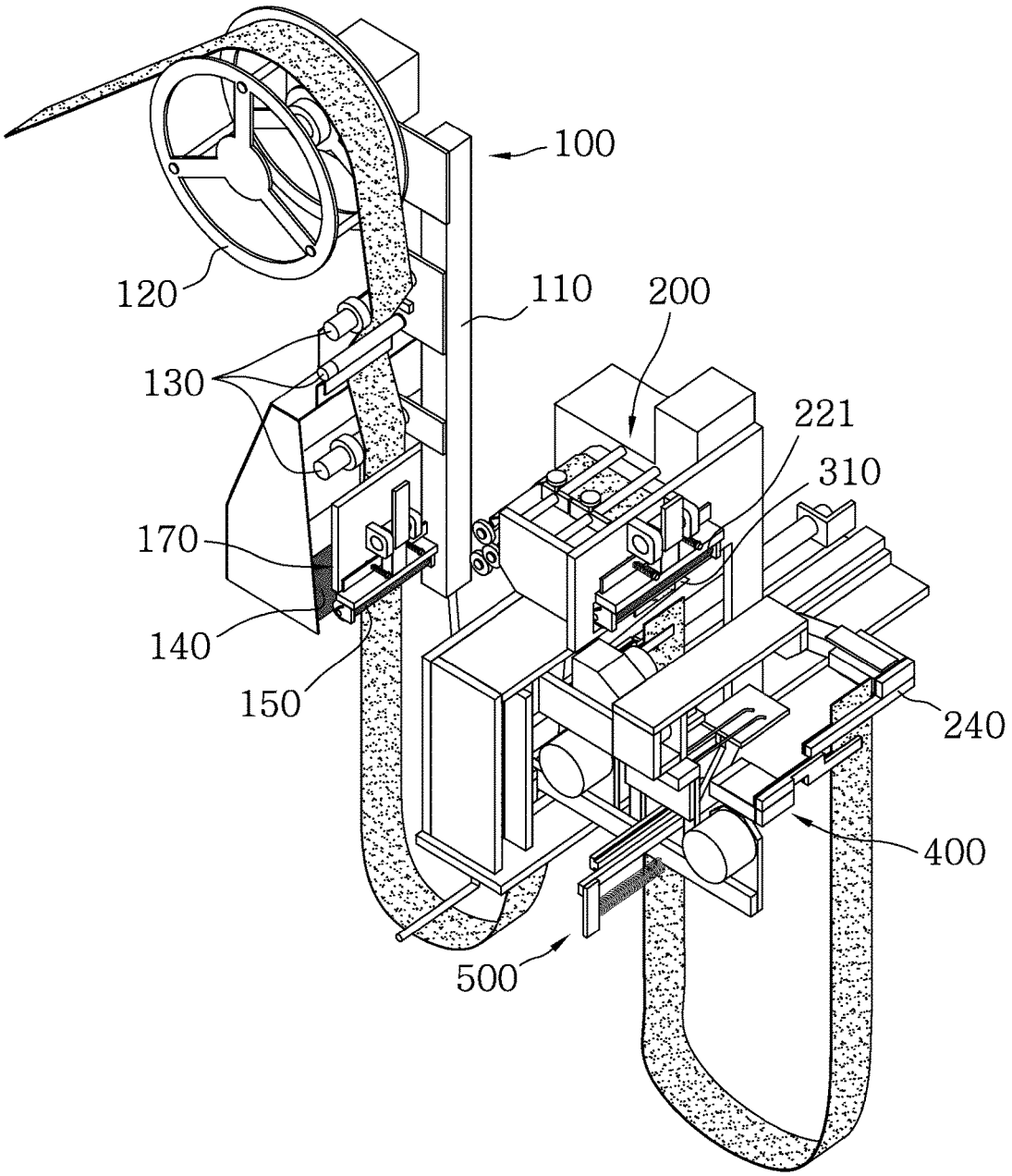
Figure 14:
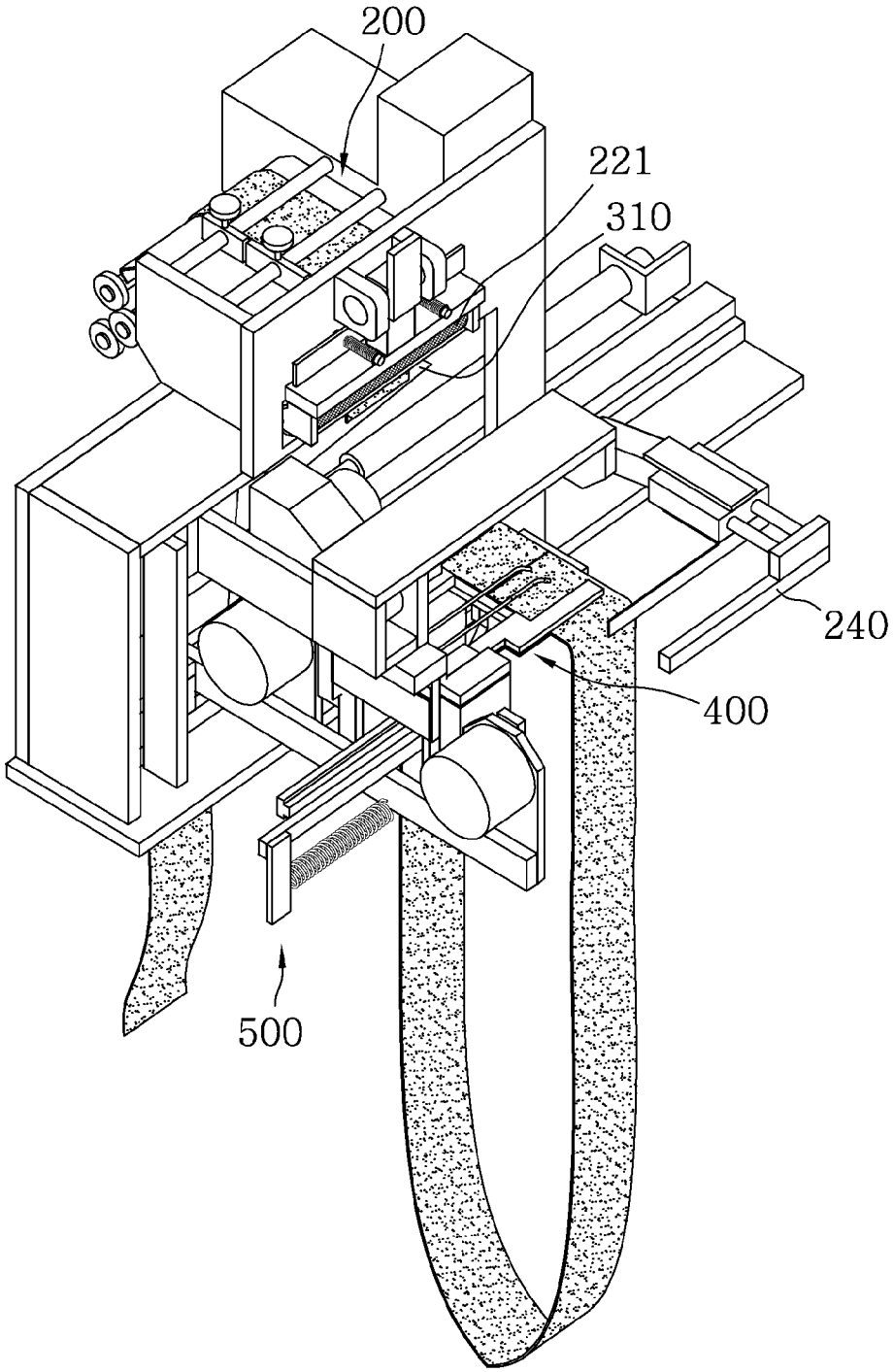
Figure 15:
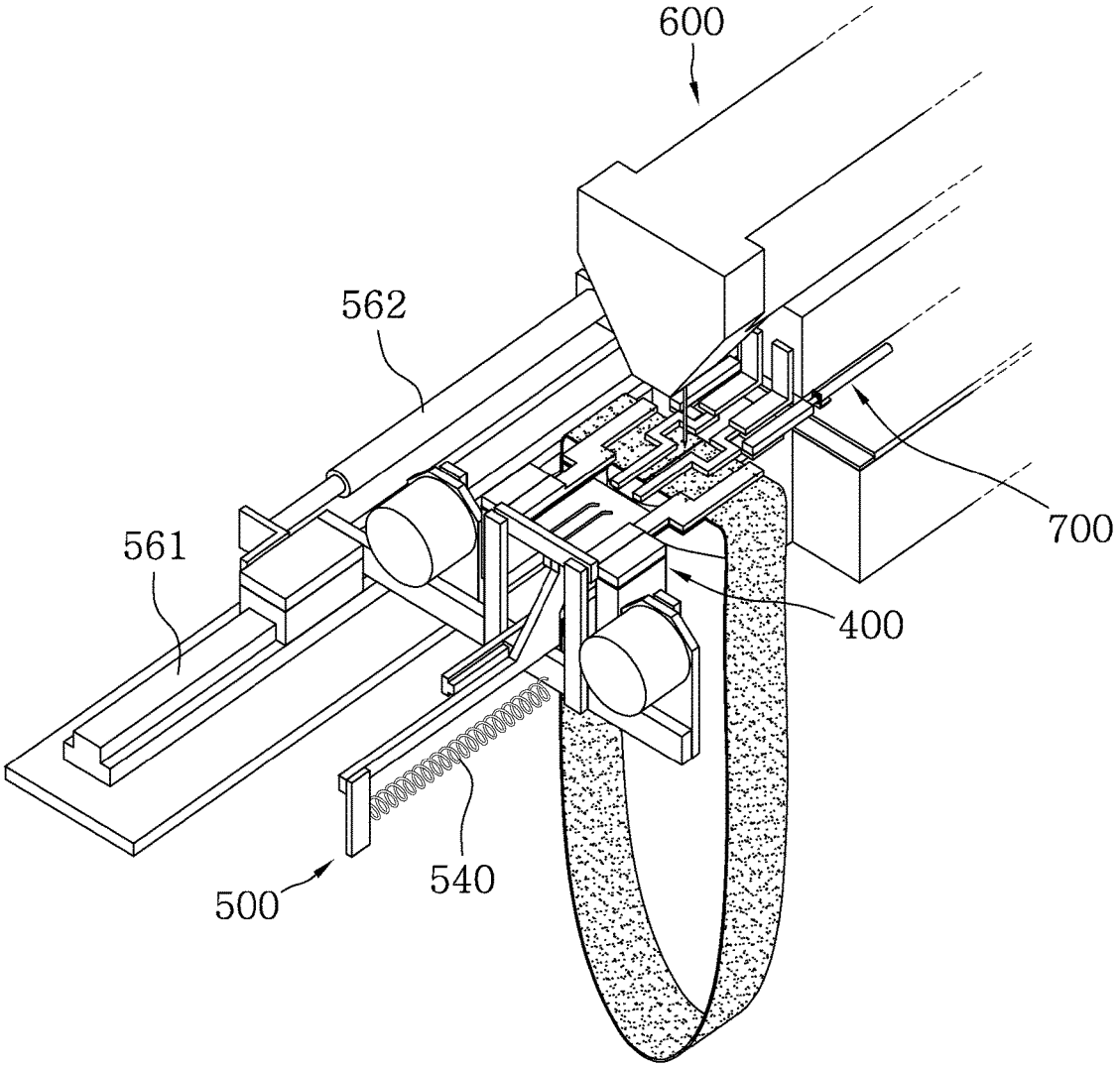
Figure 16:
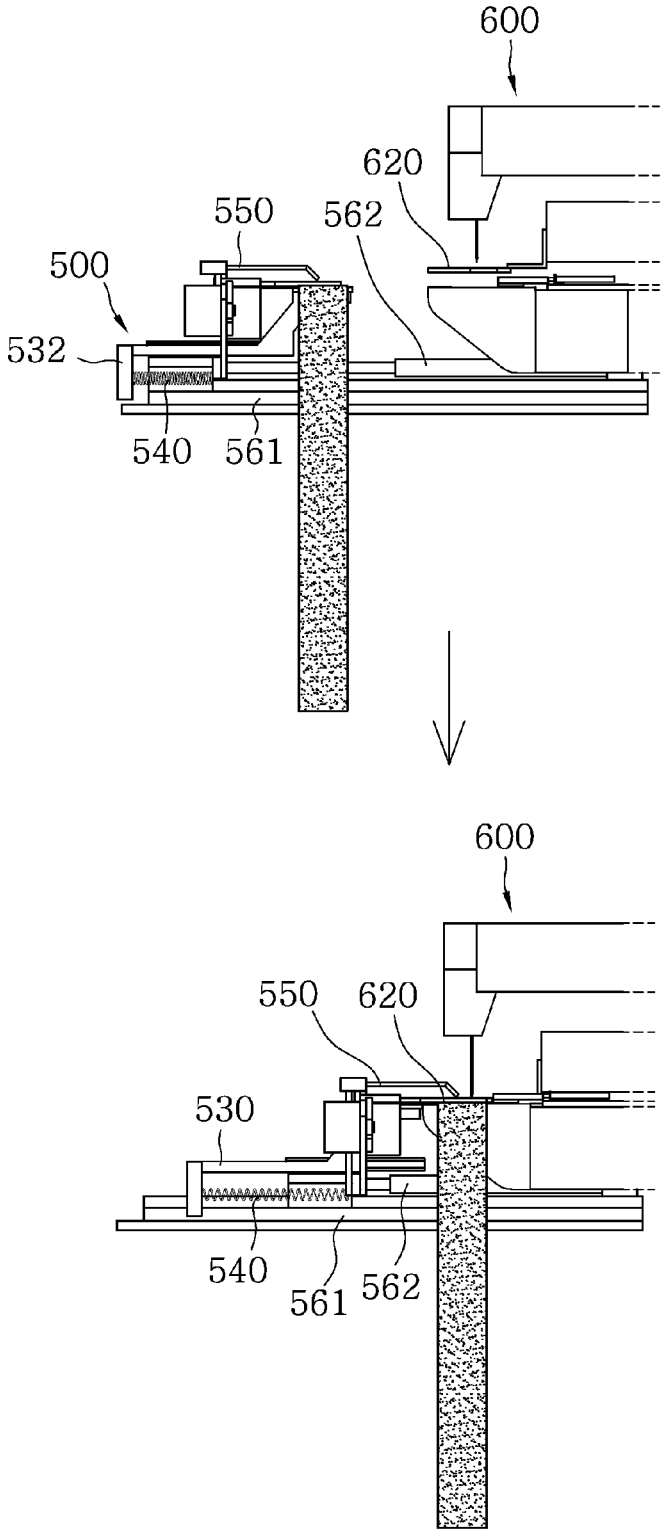
Figure 17:
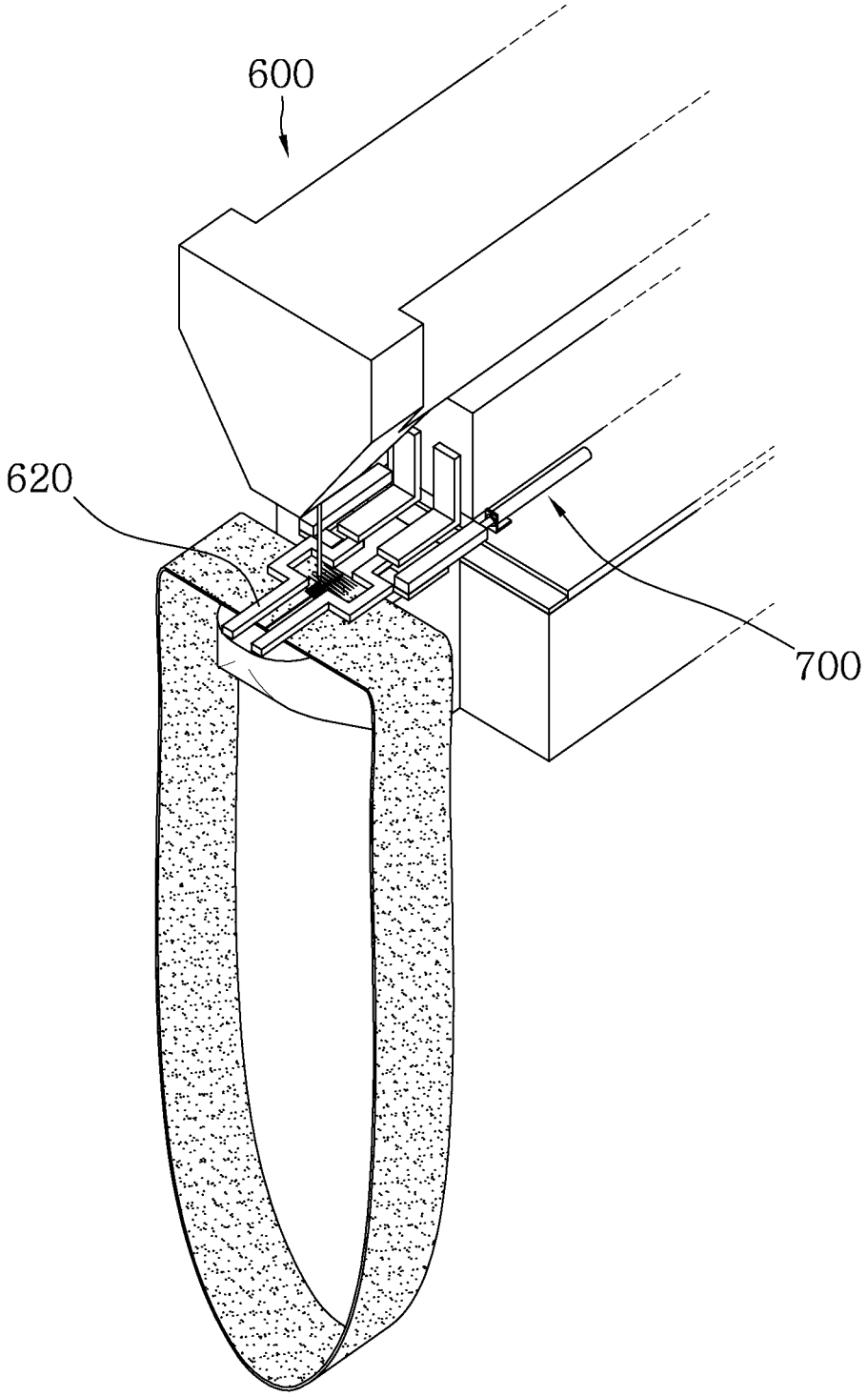

As illustrated in FIG. 11, a protective cover 950 formed of a transparent material is disposed on the support table 1 in an openable and closable manner. The protective cover 950 can be opened and closed to cover the cutting part 300, the textile gripping part 400, and the carriage 500 to block from the external environment.

The protective cover 950 may be disposed using a separate support on the support table 1, or one portion of the protective cover 950 may be hinged to the body 210 of the textile length-adjusting part 200.

The protective cover 950 can prevent an accident that would otherwise occur during the operations of griping, cutting, and sewing a strip of felt textile.

A process of fabricating a gasket pad using the apparatus of fabricating a gasket pad having the above-described configuration is illustrated in FIGS. 12 to 17.

With reference to the accompanying drawings, the process of fabricating a gasket pad will be described as follows: First, a strip of felt textile moving in an untwisted position guided by the anti-twisting drum 120 is fed to the textile guide part 230 of the textile length-adjusting part 200 by the feed roller 140. When the felt textile is withdrawn a predetermined length by the withdrawal roller, one end portion and the other end portion of the withdrawn length of the felt textile are gripped by the grippers 410, and subsequently, the other end portion of the withdrawn portion of the felt textile is cut by the cutting part 300.

One end portion and the other end portion of the cut portion of the felt textile are gripped by the grippers 410. In this state, the grippers 410 are rotated 90° upwards, thereby butting the both ends to each other on the upper surface of the support plate 531.

The felt textile portion, with both ends being butted to each other on the upper surface of the support plate 531, is prevented from becoming loose by air blown from the air supply pipes 550, and in this state, is moved to the sewing part 600 by the cylinder 562.

The other portions of the felt textile portion that has moved to the sewing surface 610 of the sewing part 600, except for the portions to be sewn, are pressed, and both ends of the felt textile portion butted to each other through the sewing space of the pressing pieces 620 are sewn.

The felt textile portion is primarily sewn in the first sewing space 621 of the pressing pieces 620. After the other butted portions of the felt textile portion are sewn through the second sewing space 622, the felt textile portion is secondarily sewn while reciprocally moving between the first sewing space and the second space, whereby the sewing operation is completed.

After the sewing operation is completed, a fabricated gasket pad is pushed using the discharging part 700, such that the gasket pad drops into the loading hopper 800 below.

After the gasket pad is dropped by the discharging part 700, the above-described process is repeatedly performed in order to fabricate gasket pads.

As described above, the apparatus of fabricating a gasket pad according to the present embodiment is an apparatus performing the automated process of feeding a strip of felt textile, cutting a portion of the felt textile by a predetermined length, butting both ends of the cut felt textile portion without a difference in height, and sewing the both ends. Since the operations that have been manually performed in the related art are automated, it is possible to advantageously improve fabrication quality and increase yield.

Figure 18:
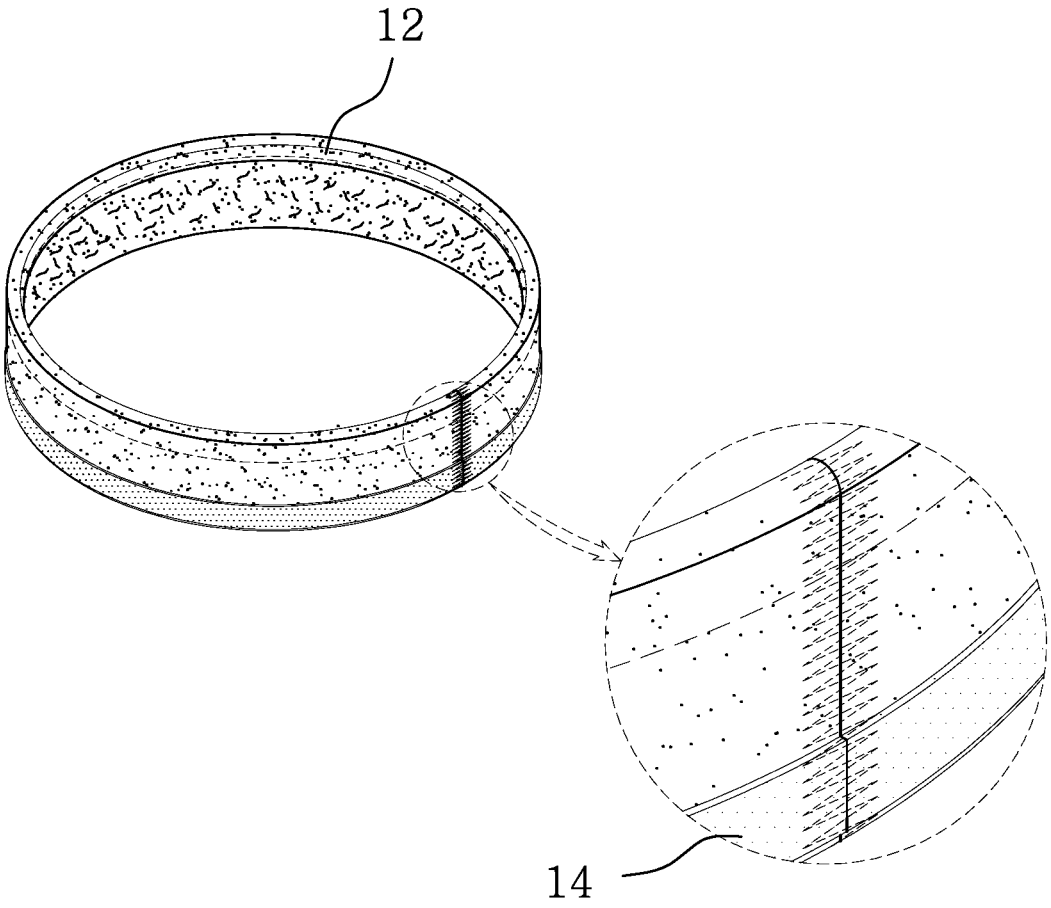
FIG. 18 is a perspective view illustrating a gasket pad fabricated by the apparatus of fabricating gasket pads for sealing a drum of a drier according to the embodiment of the present invention.
Figure 19:
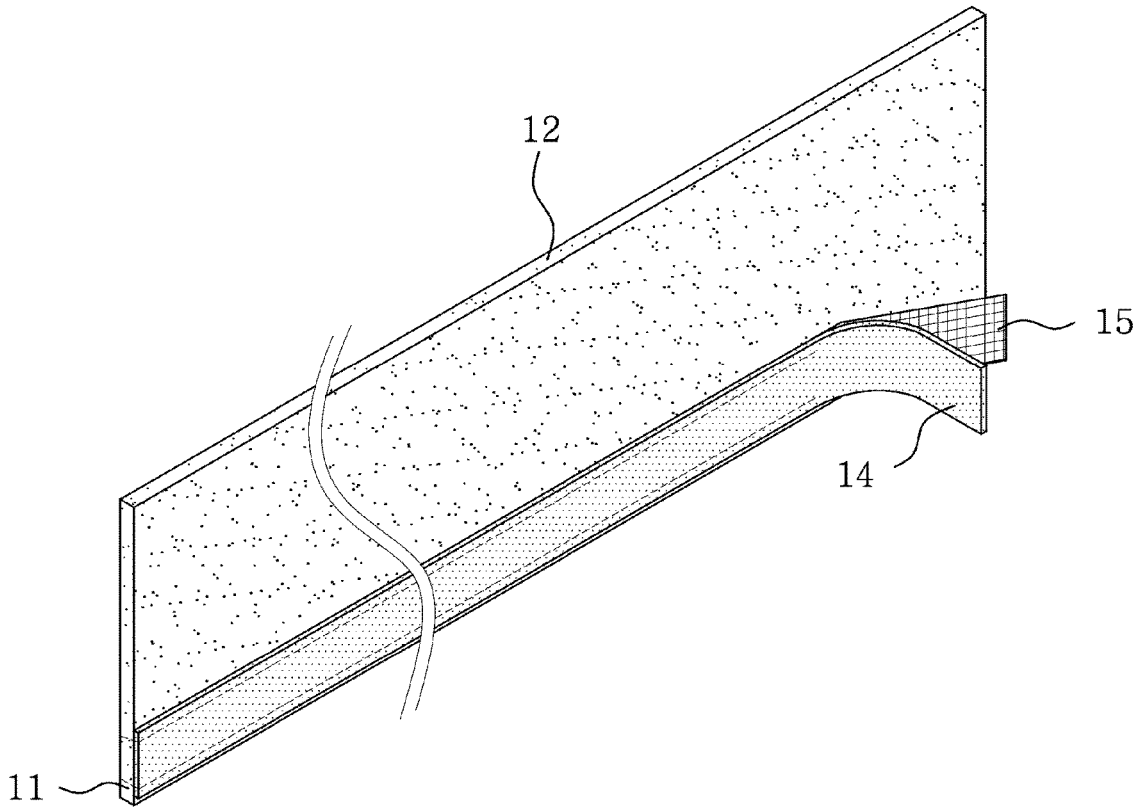
FIG. 19 is a perspective view illustrating a flexible band sewn to an edge of the gasket pad illustrated in FIG. 18.
Figure 20:
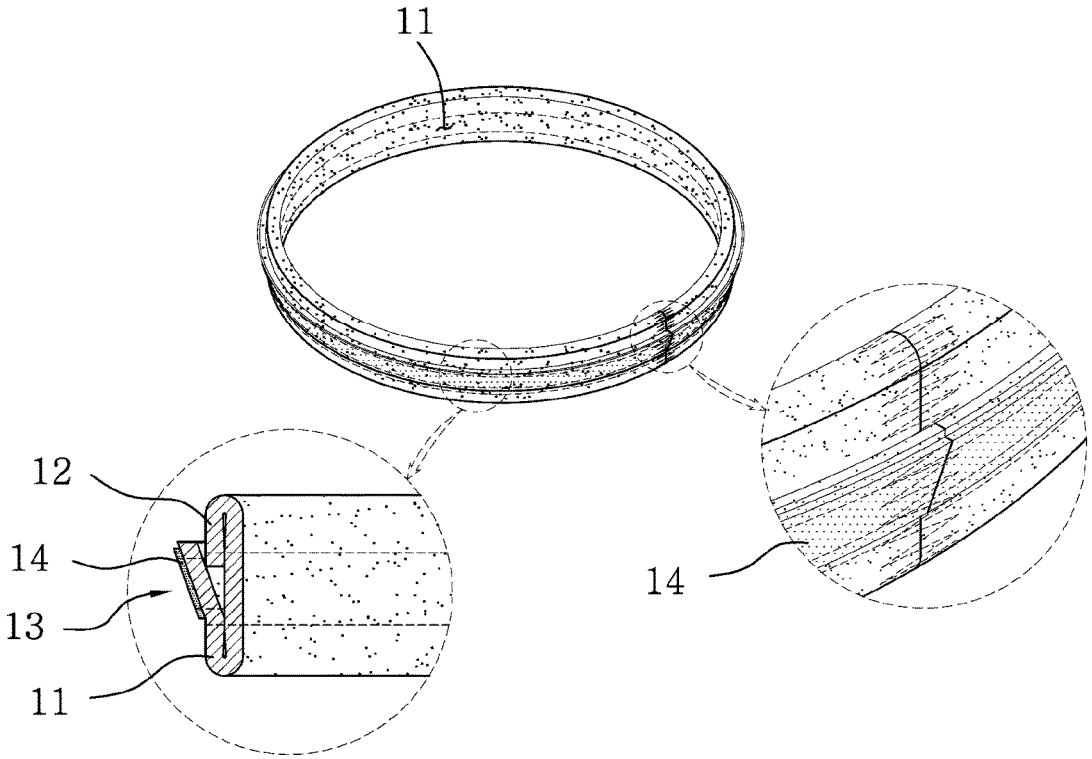
FIG. 20 is a perspective view illustrating the gasket pad illustrated in FIG. 18, in which both edges thereof are sewn in a folded position.

FIG. 18 is a perspective view illustrating a gasket pad fabricated by the apparatus of fabricating gasket pads for sealing a drum of a drier according to the present embodiment, FIG. 19 is a perspective view illustrating a flexible band sewn to an edge of one side of the gasket pad illustrated in FIG. 18, and FIG. 20 is a perspective view illustrating a gasket pad sewn by folding both edges thereof, compared to the gasket pad illustrated in FIG. 18.

As illustrated in FIG. 18, the gasket pad fabricated by the apparatus of fabricating gasket pads for sealing a drum of a drier according to the present embodiment has the shape of a ring, the width of which maintains a predetermined value, and both ends of which are sewn in a butted position.

Referring to FIG. 20, the gasket pad is sewn by folding portions of both edges 11 and 12 along the longitudinal direction of thereof, such that the both edges are double-layered. In this gasket pad, a portion of one of the folded edges forms an extent 13 covering a portion of the other edge. A flexible band 14 is placed on the surface of the extent 13 in the longitudinal direction of the gasket pad and is sewn therewith, whereby the fabrication of the gasket pad is completed.

It is preferable that the flexible band 14 is previously sewn in the longitudinal direction of the felt textile before the fabrication process of the gasket pad using the apparatus of fabricating gasket pads according to the present embodiment.

It is preferable that the flexible band 14 is formed of an elastic material selected from among rubber, synthetic resin, and silicone. A flexible band protective member 15 is bonded to the rear surface of the flexible band 14 as required in order to increase the strength of the flexible band.

When the felt textile is pulled in order to increase the ability to seal the portion to be sealed, i.e. the outer circumferential portion, of the drum, the flexible band 14 is stretched. The flexible band 14 then may suffer from cracks or may be torn. In order to prevent such problems, the flexible band protective member 15 is bonded to the flexible band 14. It is preferable that the flexible band protective member 15 is formed of a piece of net-shaped textile.

Figure 21:
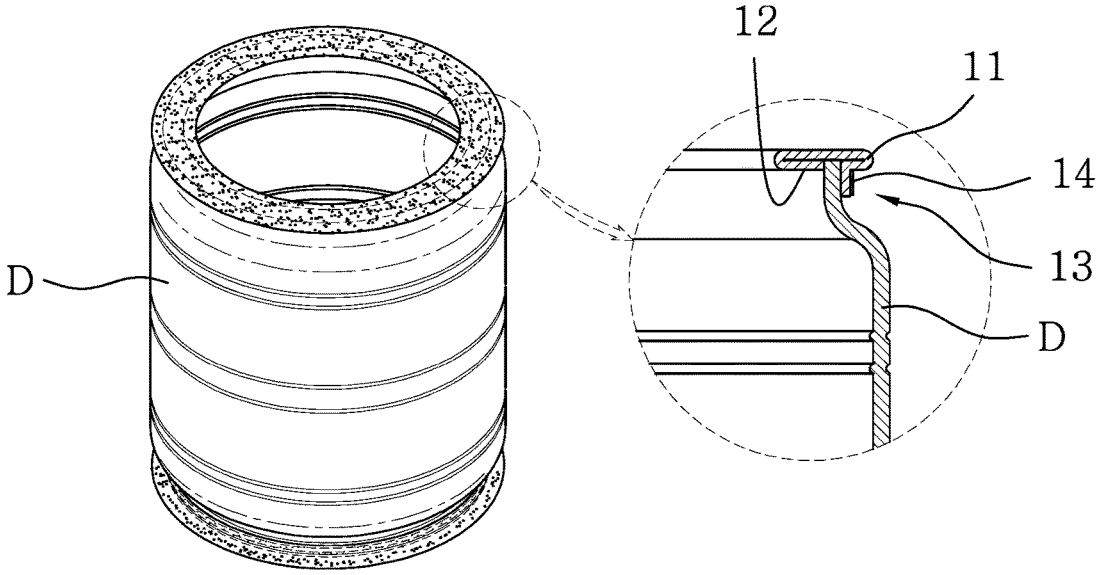
FIG. 21 is a perspective view illustrating the usage of a gasket pad for sealing a drum of a drier having a protective cover according to an embodiment of the present invention.

As illustrated in FIG. 21, the extent 13 is intended to wrap and seal the portion to be sealed, i.e. the outer circumferential portion, of the drum D. It is preferable that the width of the extent 13 is equal to or greater than the width of the other edge 12 of the gasket pad that is folded on the rear surface of the gasket pad. When the width of the extent 13 is smaller than the other folded edge 12, the area in which the drum D is wrapped is reduced, thereby reducing the sealing ability. The extent 13, the width of which is equal to or greater than the width of the other edge 12, can prevent this problem.

In addition, the felt textile of the gasket pad according to the present embodiment is a mixture of first textile and second textile. The first textile is formed of one selected from among wool, cotton, and flax fiber, or a combination thereof. The second textile is formed of one selected from among polyester, acryl, nylon, polyurethane, and polypropylene, or a combination thereof. The mixture of the first textile and the second textile is intended to improve the abrasion resistance and the thermal resistance of the felt textile and impart a predetermined level of elasticity to the felt textile, thereby improving the sealing ability of the drum.

The mixture of the first textile and the second textile includes, by weight, the first textile 20% to 60% and the second textile 40% to 80%. When the first textile exceeds 60 wt %, the elasticity is below the intended level. When the second textile exceeds 80 wt %, the abrasion resistance, the anti-static ability, and the thermal resistance are below the intended levels. It is therefore preferable that the mixing ratio of the first textile and the second textile ranges, by weight percent, from 20:80 to 60:40.

In the gasket pad for sealing a drum of a drier according to the present invention as set forth above, the felt textile of the gasket pad has abrasion resistance, elasticity, anti-static ability, and thermal resistance. A felt textile portion is sewn with both edges thereof being folded along the longitudinal direction, thereby forming a two-layer structure. This can increase the strength of the resultant gasket pad. Both ends of the felt textile portion are sewn such that a stepped portion is not formed, whereby the effect of sealing the drum can be advantageously increased.

In addition, the flexible band is sewn to the extent that wraps the outer circumference of the drum, thereby improving the ability to seal the drum and increasing the strength of the gasket pad.

Although the exemplary embodiments of the present invention have been described for illustrative purposes, a person skilled in the art will appreciate that various modifications, additions and substitutions are possible, without departing from the scope and spirit of the present invention as disclosed in the accompanying claims.

What is claimed is:

1. An apparatus for fabricating gasket pads for sealing a drum of a drier, comprising:

a textile feed guide part disposed on one side of an upper surface of a support table, the textile feed guide part comprising: an anti-twisting drum rotating in a direction opposite to a direction in which a strip of felt textile is fed such that the felt textile manufactured to maintain a predetermined width is fed without being twisted; and a feed roller and a guide roller facing each other such that the felt textile that has passed through the anti-twisting drum enters through a space between the feed roller and the guide roller in one side and exits through the other side;

a textile length-adjusting part disposed downstream of the textile feed guide part, the textile length-adjusting part comprising: a body; a withdrawal roller disposed on one side of the body to be in close contact with one surface of the felt textile fed by the feed roller, wherein the withdrawal roller is rotation-controlled by a motor such that a predetermined length of the felt textile that has entered through one side is withdrawn through the other side; a support roller facing the withdrawal roller to rotate when the withdrawal roller rotates; a textile gripper disposed downstream of the withdrawal roller to grip one end portion of the felt textile withdrawn by the withdrawal roller; and a textile gripper moving part reversing the textile gripper to obtain a withdrawal space for the felt textile;

a cutting part disposed under the withdrawal roller to cut a felt textile portion of the felt textile withdrawn by the predetermined length;

a textile gripping part comprising: two grippers spaced apart from each other, the grippers holding and gripping one end portion of the felt textile portion gripped by the textile gripper and the other end portion of the felt textile portion that has passed through the withdrawal roller and is cut by the cutting part; and a rotating part rotating the grippers to butt one end portion of the felt textile portion and the other end portion of the felt textile portion to each other;

a carriage, wherein the grippers are disposed on both sides of an upper portion of the carriage, and wherein the carriage comprises: a felt textile support part disposed on a central portion and having a support plate supporting one end portion and the other end portion of the felt textile portion butted to each other; air supply pipes disposed to blow air onto upper surfaces of one end portion and the other end portion of the felt textile portion butted to each other and placed on the support; and a movement controlling part allowing the carriage to move to a sewing part;

a sewing part disposed on the other side of the upper surface of the support table, wherein the sewing part presses the felt textile portion moved by the carriage and placed on a sewing surface using pressing pieces and sews the felt textile portion pressed by the pressing pieces;

a discharging part disposed on the sewing part to push a side of a gasket pad that has been completely sewn such that the gasket pad drops to a loading hopper;

the loading hopper disposed below the support table to accommodate the gasket pad dropped by the discharging part; and a control part disposed at a selected position on the upper surface of the support table.

2. The apparatus according to claim 1, wherein the textile feed guide part comprises:

a support;

an anti-twisting drum disposed an upper portion of the support, whereby the felt textile is fed without twisting;

a plurality of guide rods disposed in a middle portion of the support to guide movement of the felt textile that has passed through the anti-twisting drum;

the feed roller disposed on a lower portion of the support such that the feed roller is in close contact with one surface of the felt textile, wherein the feed roller rotates to pull the felt fiber and feed the felt fiber to the textile length-adjusting part;

the guide roller facing the feed roller, wherein the guide roller rotates when the feed roller rotates; and a feed roller controlling part limiting feed of the felt textile by controlling operation of the feed roller.

3. The apparatus according to claim 2, wherein the feed roller controlling part comprises:

a measuring bar, wherein one end thereof is placed on an upper surface of the felt textile entering the textile length-adjusting part;

a rotation angle detector disposed on the other end of the measuring bar, wherein the rotation angle detector detects an angle of rotation of the measuring bar and sends a detection signal to a motor controller;

the motor controller controlling a feed roller driving motor in response to the detection signal received from the rotation angle detector;

the feed roller driving motor directly or indirectly connected to the feed roller to rotate the feed roller.

4. The apparatus according to claim 2, wherein the guide roller is configured to come into close contact with the other surface of the felt textile by elastic force applied by the first pressing part, and wherein the first pressing part comprises:

a pressing member support plate disposed perpendicular to the support;

a roller fixing member having a central portion coupled to an outer surface of the pressing member support plate by means of a hinge shaft, the guide roller being horizontally disposed below the roller fixing member; and an elasticity-applying part disposed on a lower portion of the pressing member support plate to apply elastic force to the guide roller, the elasticity-applying part comprising a bolt and a spring.

5. The apparatus according to claim 1, wherein a textile guide part is disposed upstream of the withdrawal roller to guide the felt textile fed by the feed roller such that the felt textile enters in a direction perpendicular to a longitudinal direction of the withdrawal roller.

6. The apparatus according to claim 5, wherein the textile guide part comprises:

a backing member disposed on one side of the body to support the felt textile;

an upper support rod disposed above and apart from the backing member to prevent the felt textile moving while being supported on the backing members from becoming loose; and a close contact plate disposed on the upper support rod such that a position thereof is adjustable, wherein the close contact plate is fixed by a corresponding fixing member, and supports one surface of the felt textile through close contact therewith, whereby the other surface of the felt textile is brought into close contact with one surface of the body.

7. The apparatus according to claim 5, wherein the support roller is disposed to be in close contact with one surface of the felt textile, and wherein the second pressing part comprises:

a roller fixing member having a portion coupled to one side of an outer surface of the body by means of a hinge shaft, the support roller being horizontally disposed below the roller fixing member; and an elasticity applying part disposed on a lower portion of the roller fixing member to apply elastic force to the support roller, the elasticity applying part comprising a bolt and a spring.

8. The apparatus according to claim 1, wherein the cutting part comprises:

a cutting blade, one portion of which is pivotably coupled the body of the textile length-adjusting part; and a blade rotating part disposed on one end of the pivot shaft, wherein the blade rotating part rotates the cutting blade by applying force from the pivot shaft to the cutting blade.

9. The apparatus according to claim 1, wherein the cutting part comprises a laser generator disposed on the body of the textile length-adjusting part, wherein the laser generator cuts the felt textile by irradiating the felt textile with a laser beam.

10. The apparatus according to claim 1, wherein each of the grippers comprises:

a cylinder;

a first holding plate disposed on a rod end of the cylinder; and a second holding plate disposed on one end of the cylinder to face the first holding plate, wherein the second holding plate comes into close contact with the first holding plate in response to an entering operation of the rod, and wherein the rotating part comprises an air motor coupled to the cylinder to rotate the cylinder.

11. The apparatus according to claim 1, wherein the carriage comprises:

a carriage body, wherein the grippers are disposed on both sides of the carriage body;

a guide rail disposed on a central portion of the carriage body, in a direction of the sewing part;

a felt textile support part, wherein the support plate reciprocally moves by being guided by the guide rail, the support plate is disposed on an upper surface of one side of the felt textile support part, and a stopper is disposed on the other side of the felt textile support part;

an elastic spring disposed between the carriage body and the other side of the felt textile support part or the stopper, wherein the elastic spring applies elastic force to the felt textile support part when the support collides with a side surface of the sewing part;

air supply pipes disposed above the carriage body to blow air onto upper surfaces of one end portion and the other end portion of the felt textile placed on the support.

12. The apparatus according to claim 11, wherein the movement controlling part comprises:

a carriage guide rail disposed in a direction of the sewing part, one side of the carriage body being bound to the carriage guide rail, wherein the carriage guide rail guides the carriage body to move toward the sewing part;

a cylinder causing the carriage body to move on the carriage guide rail.

13. The apparatus according to claim 1, wherein a sewing space between the pressing pieces comprises a first sewing space positioned at one side and a second sewing space positioned at the other side, a width of the first sewing space being greater than a width of the second sewing space, wherein, after the felt textile is primarily fixed by sewing a first sewing line in the first sewing space, and secondary sewing is performed along a second sewing line shorter than the first sewing line while reciprocally moving between the second sewing space and the first sewing space.

14. The apparatus according to claim 1, wherein the support table is positioned at a predetermined height such that the loading hopper is disposed below the support table, and wherein the loading hopper comprises:

a loading bucket that opens in an upper side and a lateral side;

a withdrawal plate disposed to be reciprocally movable within the loading bucket, wherein the withdrawal plate withdraws gasket pads loaded therein through the open lateral side; and a withdrawal cylinder reciprocally moving the withdrawal plate.

15. The apparatus according to claim 1, wherein the support table comprises a protective cover disposed in an openable and closable manner, the protective cover being formed of a transparent material, wherein the protective cover blocks the cutting part, the textile gripping part, and the carriage from an external environment.

* * * * *